US006824372B2

(12) United States Patent
Berrigan et al.

(10) Patent No.: US 6,824,372 B2
(45) Date of Patent: Nov. 30, 2004

(54) FIBER-FORMING APPARATUS

(75) Inventors: Michael R. Berrigan, Oakdale, MN (US); William T. Fay, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/370,022

(22) Filed: Feb. 19, 2003

(65) Prior Publication Data

US 2003/0147983 A1 Aug. 7, 2003

Related U.S. Application Data

(63) Continuation of application No. 09/835,904, filed on Apr. 16, 2001, now Pat. No. 6,607,624, which is a continuation-in-part of application No. 09/716,786, filed on Nov. 20, 2000, now abandoned.

(51) Int. Cl.[7] ..... B29C 47/08

(52) U.S. Cl. ..... 425/72.2; 425/378.2; 425/382.2

(58) Field of Search ..... 425/378.2, 382.2, 425/72.1, 72.2, 464

(56) References Cited

U.S. PATENT DOCUMENTS

| | | | | |
|---|---|---|---|---|
| 3,502,763 | A | 3/1970 | Hartmann | 264/555 |
| 3,528,129 | A | 9/1970 | Hartmann | 425/224 |
| 3,692,618 | A | 9/1972 | Dorschner et al. | 442/401 |
| 3,734,803 | A | 5/1973 | Lipscomb et al. | 156/441 |
| 3,766,606 | A | 10/1973 | Piper et al. | 28/283 |
| 3,855,045 | A | 12/1974 | Brock | 428/198 |
| 3,945,815 | A | 3/1976 | Schmidt | 65/533 |
| 4,064,605 | A | 12/1977 | Akiyama et al. | 28/100 |
| 4,086,381 | A | 4/1978 | Cheshire et al. | 428/113 |
| 4,135,903 | A | 1/1979 | Ohsato et al. | 65/466 |
| 4,147,749 | A | 4/1979 | Lipscomb et al. | 264/167 |
| 4,163,819 | A | 8/1979 | Yung et al. | 428/198 |
| 4,173,443 | A | 11/1979 | Lin | 425/66 |
| 4,189,338 | A | 2/1980 | Ejima et al. | 156/167 |
| 4,202,855 | A | 5/1980 | Gerking et al. | 264/210.2 |
| 4,217,387 | A | 8/1980 | Viezee et al. | 442/401 |
| 4,300,876 | A | 11/1981 | Kane et al. | 425/66 |
| 4,340,563 | A | 7/1982 | Appel et al. | 264/518 |
| 4,405,297 | A | 9/1983 | Appel et al. | 425/72.2 |
| 4,622,259 | A | 11/1986 | McAmish et al. | 428/171 |
| 4,627,811 | A | 12/1986 | Greiser et al. | 425/72.2 |

(List continued on next page.)

FOREIGN PATENT DOCUMENTS

| | | |
|---|---|---|
| DE | 40 14 414 | 7/1991 |
| DE | 42 10 464 A1 | 10/1993 |
| EP | 0 638 480 | 4/1993 |
| WO | WO 00/28123 | 5/2000 |
| WO | WO 00/65134 | 11/2000 |
| WO | WO 02/055782 | 7/2002 |

*Primary Examiner*—Benjamin L. Utech
*Assistant Examiner*—Emmanuel S. Luk
(74) *Attorney, Agent, or Firm*—Roger R. Tamte

(57) ABSTRACT

A new fiber-forming method, and apparatus useful for performing the method, are taught in which extruded filaments of fiber-forming material are directed through a processing chamber that is defined by two parallel walls, at least one of which is instantaneously movable toward and away from the other wall; preferably both walls are instantaneously movable toward and away from one another. Movement means provide instantaneous movement to the at least one movable wall. In one embodiment, the movement means comprises biasing means for resiliently biasing the wall toward the other wall. Movement of the wall toward and away from the other wall is sufficiently easy and rapid that the wall will move away from the other wall in response to increases in pressure within the chamber but will be quickly returned to its original position by the biasing means upon resumption of the original pressure within the chamber. In another embodiment the movement means comprises oscillating means for oscillating the wall at a rapid rate. Other movement means are also described.

16 Claims, 6 Drawing Sheets

U.S. PATENT DOCUMENTS 4,692,106 A 9/1987 Grabowski et al. ..... 425/66
4,812,112 A 3/1989 Balk ..... 425/66
4,820,459 A 4/1989 Reifenhauser ..... 264/40.3
4,838,774 A 6/1989 Balk ..... 425/66
4,908,163 A 3/1990 McAmish et al. ..... 264/12
4,961,695 A 10/1990 Hirschmann et al. ..... 425/72.2
4,988,560 A 1/1991 Meyer et al. ..... 442/344
5,244,723 A 9/1993 Anderson et al. ..... 442/351
5,270,107 A 12/1993 Gessner ..... 442/356
5,292,239 A 3/1994 Zeldin et al. ..... 425/66
5,296,286 A 3/1994 Allen et al. ..... 442/347
5,340,517 A 8/1994 Koschinek et al. ..... 264/103
5,405,559 A 4/1995 Shambaugh ..... 264/6
5,460,500 A 10/1995 Geus et al. ..... 425/66
5,476,616 A 12/1995 Schwarz ..... 264/6
5,525,286 A 6/1996 Bornmann et al. ..... 264/444
5,545,371 A 8/1996 Lu ..... 264/555
5,547,746 A 8/1996 Burton, Sr. ..... 442/382
5,571,537 A 11/1996 Geus et al. ..... 425/72.2
5,599,488 A 2/1997 Prof e ..... 264/403
5,645,790 A 7/1997 Schwarz et al. ..... 264/555
5,648,041 A 7/1997 Rodgers et al. ..... 264/555
5,652,048 A 7/1997 Haynes et al. ..... 442/351
5,667,749 A 9/1997 Lau et al. ..... 264/555
5,688,468 A 11/1997 Lu ..... 264/55
5,711,970 A 1/1998 Lau et al. ..... 425/72.2
5,714,171 A 2/1998 Profe ..... 425/66
5,807,795 A 9/1998 Lau et al. ..... 442/334
5,814,349 A 9/1998 Geus et al. ..... 425/66
5,863,639 A 1/1999 Franke et al. ..... 428/198
5,885,909 A 3/1999 Rudisill et al. ..... 442/82
6,010,588 A 1/2000 Stahl et al. ..... 156/167
6,013,223 A 1/2000 Schwarz ..... 264/555
6,117,801 A 9/2000 McGinty et al. ..... 442/352
6,136,245 A 10/2000 Lu ..... 264/210.8
6,165,217 A 12/2000 Hayes ..... 623/11.1
6,183,684 B1 2/2001 Lu ..... 264/555
6,274,238 B1 8/2001 DeLucia ..... 428/373
6,379,136 B1 4/2002 Najour et al. ..... 425/66

FIBER-FORMING APPARATUS

REFERENCE TO RELATED APPLICATION

This application is a continuation of application Ser. No. 09/835,904, filed Apr. 16, 2001, now U.S. Pat. No. 6,607, 624, which itself was a continuation-in-part of application Ser. No. 09/716,786, filed Nov. 20, 2000, now abandoned.

FIELD OF INVENTION

This invention relates to fiber-forming apparatus having a chamber through which fibers are passed for operations such as drawing, orienting and attenuation.

BACKGROUND OF THE INVENTION

In many fiber-forming processes, filamentary material extruded from a die is directed through a processing chamber where, for example, the filamentary material is drawn, oriented and/or reduced in diameter. Such a processing or attenuation chamber is commonly used in spun-bond processes (see U.S. Pat. Nos. 3,502,763; 3,692,618; 4,064,605; 4,217,387; 4,812,112; 4,820,459; 5,270,107; 5,292,239; 5,571,537; 5,648,041; and 5,688,468). But it also can be used in other processes, such as meltblowing processes (see U.S. Pat. Nos. 4,622,259 and 4,988,560), meltspinning of filaments and filament yarns (see U.S. Pat. No. 4,202,855), and flashspinning of plexifilamentary film-fibril material.

Use of a processing chamber places restrictions on the whole fiber-forming process—restrictions intended to assure that fibers will travel through the chamber effectively without, for example, plugging the chamber. Such restrictions include limits on the speed of the fibers as they move through the chamber; limits on the configuration of the chamber to allow threading of fibers through the chamber and rethreading upon breakage of fibers; and limits on the degree to which the extruded fibers are molten or liquid as they enter the chamber.

Various efforts have been made to improve processing chambers and reduce the restrictions they impose on the fiber-forming process. One proposal is to use a wide-throated entry for the chamber, and form the chamber with a movable wall that is moved into place after polymer flow begins and which may be moved out of place if plugging occurs; see U.S. Pat. Nos. 4,405,297 and 4,340,563 as well as 4,627,811. Alternatively, U.S. Pat. No. 6,136,245 proposes beginning the fiber-forming process slowly and with a processing chamber spaced further from the extrusion die than the intended operating distance; the process is then gradually accelerated and the processing chamber moved closer to the die until it is eventually in the operating position.

In a different effort intended to achieve uniform fiber velocity across the width of an attenuation chamber, the walls of the chamber are made of a flexible material, and a grid of pressure sensors is used to activate local changes in the geometry of the wall to attempt to equalize the pressure through the chamber width; see U.S. Pat. No. 5,599,488. U.S. Pat. No. 4,300,876 describes a blower structure having only one wall curved to provide a Coanda air stream within which extruded filaments are entrained.

All of these approaches continue to leave important restrictions imposed on fiber-forming processes by use of a processing chamber.

SUMMARY OF THE INVENTION

The present invention provides a new fiber-forming method, and apparatus useful to carry out the method, that not only alleviate many of the limitations imposed by use of a processing chamber, but more than that, greatly expand fiber-forming and fibrous-web-forming opportunities. In the new fiber-forming method, extruded filaments of fiber-forming material are directed through a processing chamber that is defined by two parallel walls, at least one of which is instantaneously movable toward and away from the other wall; preferably both walls are instantaneously movable toward and away from one another. By "instantaneously movable" it is meant that the movement occurs quickly enough that the fiber-forming process is essentially uninterrupted; e.g., there is no need to stop the process and re-start it. If, for example, a nonwoven web is being collected, collection of the web can continue without stopping the collector, and a substantially uniform web is collected.

The wall(s) can be moved by a variety of movement means. In one embodiment the at least one movable wall is resiliently biased toward the other wall; and a biasing force is selected that establishes a dynamic equilibrium between the fluid pressure within the chamber and the biasing force. Thus, the wall can move away from the other wall in response to increases in pressure within the chamber, but it is quickly returned to the equilibrium position by the biasing force upon resumption of the original pressure within the chamber. If extruded filamentary material sticks or accumulates on the walls to cause an increased pressure in the chamber, at least one wall rapidly moves away from the other wall to release the accumulated extrudate, whereupon the pressure is quickly reduced, and the movable wall returns to its original position. Although some brief change in the operating parameters of the process may occur during the movement of the wall(s), no stoppage of the process occurs, but instead fibers continue to be formed and collected.

In a different embodiment of the invention the movement means is an oscillator that rapidly oscillates the wall(s) between its original position defining the chamber space, and a second position further from the other wall. Oscillation occurs rapidly, causing essentially no interruption of the fiber-forming process, and any extrudate accumulated in the processing chamber that could plug the chamber is regularly released by the spreading apart of the wall(s).

In general, a new fiber-forming method of the invention comprises a) extruding filaments of fiber-forming material; b) directing the filaments through a processing chamber defined by two parallel walls, at least one of the walls being instantaneously movable toward and away from the other wall and being subject to movement means for causing instantaneous movement during passage of filaments; and c) collecting the processed filaments.

A processing chamber having an instantaneously movable wall as described makes possible great changes in the fiber-forming process. Procedures and parameters that were previously not useful because of the danger of plugging of the processing chamber now become possible. Fiber velocities, polymer flow rates, and degrees to which the polymer is molten or liquid upon entering the processing chamber can be varied to create improved as well as essentially new processes. The invention is especially useful to enhance processes of direct web formation, i.e., processes in which fiber-forming material is directly converted into nonwoven web form, without separate formation of fibers that are then assembled into a web in a different process.

In brief summary, a new apparatus of the invention generally comprises a) an extrusion head for extruding filaments of fiber-forming material through orifices in a die, b) a chamber aligned to receive the extruded filaments for passage through the chamber, the chamber being defined by two parallel walls, at least one of the walls being instantaneously movable toward and away from the other wall; and c) movement means for moving the at least one wall, e.g., resiliently biasing the wall toward the other wall or oscillating the wall toward and away from the other wall. Movement of the wall toward and away from the other wall is sufficiently easy as to allow the described rapid or instantaneous movement, e.g., the wall will move away from the other wall in response to increases in pressure within the chamber but will be quickly returned to its original position by the biasing means upon resumption of the original pressure within the chamber; or the oscillating means will rapidly oscillate the wall between closer and further spacings.

The present invention also provides new products. For example, as discussed in more detail later in this specification, collected masses of fibers from a fiber-forming process of the invention may include fibers that are interrupted along their length, e.g., by a fiber break or entanglement. The fiber segment where the interruption occurs may differ from the main portion of the fiber in important properties, e.g., in morphological characteristics that are manifested as differences in melting point, cold-crystallization temperature, glass transition temperature, crystallinity index (indicating the proportion of the fiber that is crystalline), or crystalline type. These differences can be detected by differential scanning calorimetry or X-ray scattering. Collected masses of fibers as described are a consequence of the beneficial new fiber-forming process of the invention; and in addition, the new webs offer beneficial properties themselves. One such useful product of the invention comprises a coherent mass of fibers in web form, the mass of fibers including fibers randomly interrupted along their length by segments that are fiber-like, and are less than 300 micrometers in diameter but larger in diameter than the main portion of the fiber.

DESCRIPTION OF THE PREFERRED EMBODIMENTS

Figure 1:
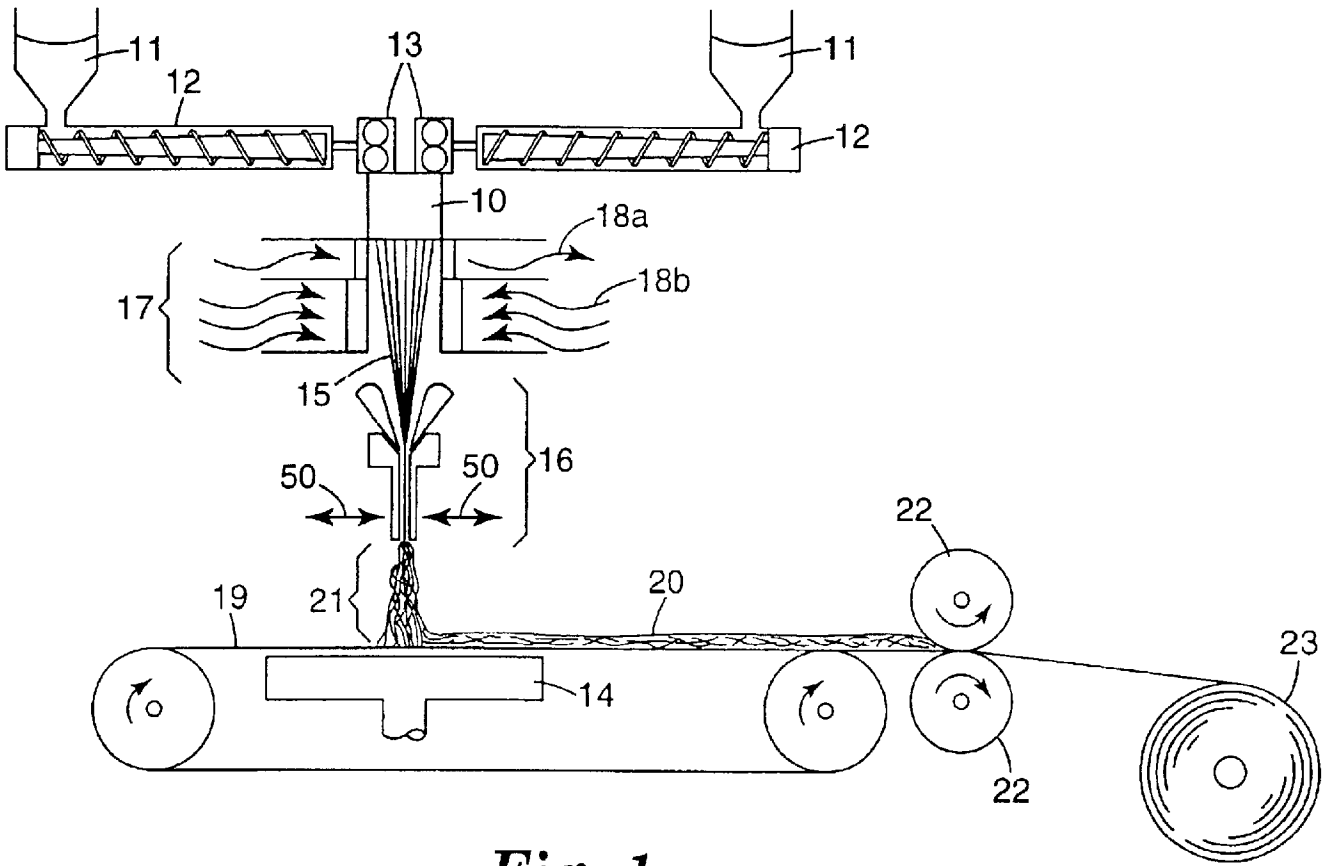
FIG. 1 is a schematic overall diagram of apparatus of the invention for forming a nonwoven fibrous web.

FIG. 1 shows an illustrative apparatus of the invention. Fiber-forming material is brought to an extrusion head 10—in this illustrative apparatus, by introducing a fiber-forming material into hoppers 11, melting the material in an extruder 12, and pumping the molten material into the extrusion head 10 through a pump 13. Although solid polymeric material in pellet or other particulate form is most commonly used and melted to a liquid, pumpable state, other fiber-forming liquids such as polymer solutions could also be used.

The extrusion head 10 may be a conventional spinnerette or spin pack, generally including multiple orifices arranged in a regular pattern, e.g., straightline rows. Filaments 15 of fiber-forming liquid are extruded from the extrusion head and conveyed to a processing chamber or attenuator 16. The distance 17 the extruded filaments 15 travel before reaching the attenuator 16 can vary, as can the conditions to which they are exposed. Typically, quenching streams of air or other gas 18 are presented to the extruded filaments by conventional methods and apparatus to reduce the temperature of the extruded filaments 15. Alternatively, the streams of air or other gas may be heated to facilitate drawing of the fibers. There may be one or more streams of air (or other fluid)—e.g., a first air stream 18*a* blown transversely to the filament stream, which may remove undesired gaseous materials or fumes released during extrusion; and a second quenching air stream 18*b* that achieves a major desired temperature reduction.

Depending on the process being used or the form of finished product desired, the quenching air may be sufficient to solidify the extruded filaments 15 before they reach the attenuator 16. In other cases the extruded filaments are still in a softened or molten condition when they enter the attenuator. Alternatively, no quenching streams are used; in such a case ambient air or other fluid between the extrusion head 10 and the attenuator 16 may be a medium for any change in the extruded filaments before they enter the attenuator.

The filaments 15 pass through the attenuator 16, as discussed in more detail below, and then exit. Most often, as pictured in FIG. 1, they exit onto a collector 19 where they are collected as a mass of fibers 20 that may or may not be coherent and take the form of a handleable web. The invention is particularly useful for a direct-web-formation process in which a fiber-forming polymeric material is converted into a web in one essentially direct operation, such as is done in spunbond or meltblown processes. Alternatively, fibers exiting the attenuator may take the form of monofilaments, tow or yarn, which may be wound onto a storage spool or further processed.

The collector 19 is generally porous and a gas-withdrawal device 14 can be positioned below the collector to assist deposition of fibers onto the collector. The distance 21 between the attenuator exit and the collector may be varied to obtain different effects. The collected mass 20 may be conveyed to other apparatus such as calenders, embossing stations, laminators, cutters and the like; or it may be passed through drive rolls 22 and wound into a storage roll 23. After passing through a processing chamber of the invention, but prior to collection, extruded filaments or fibers may be subjected to a number of additional processing steps not illustrated in FIG. 1, e.g., further drawing, spraying, etc.

Figure 2:
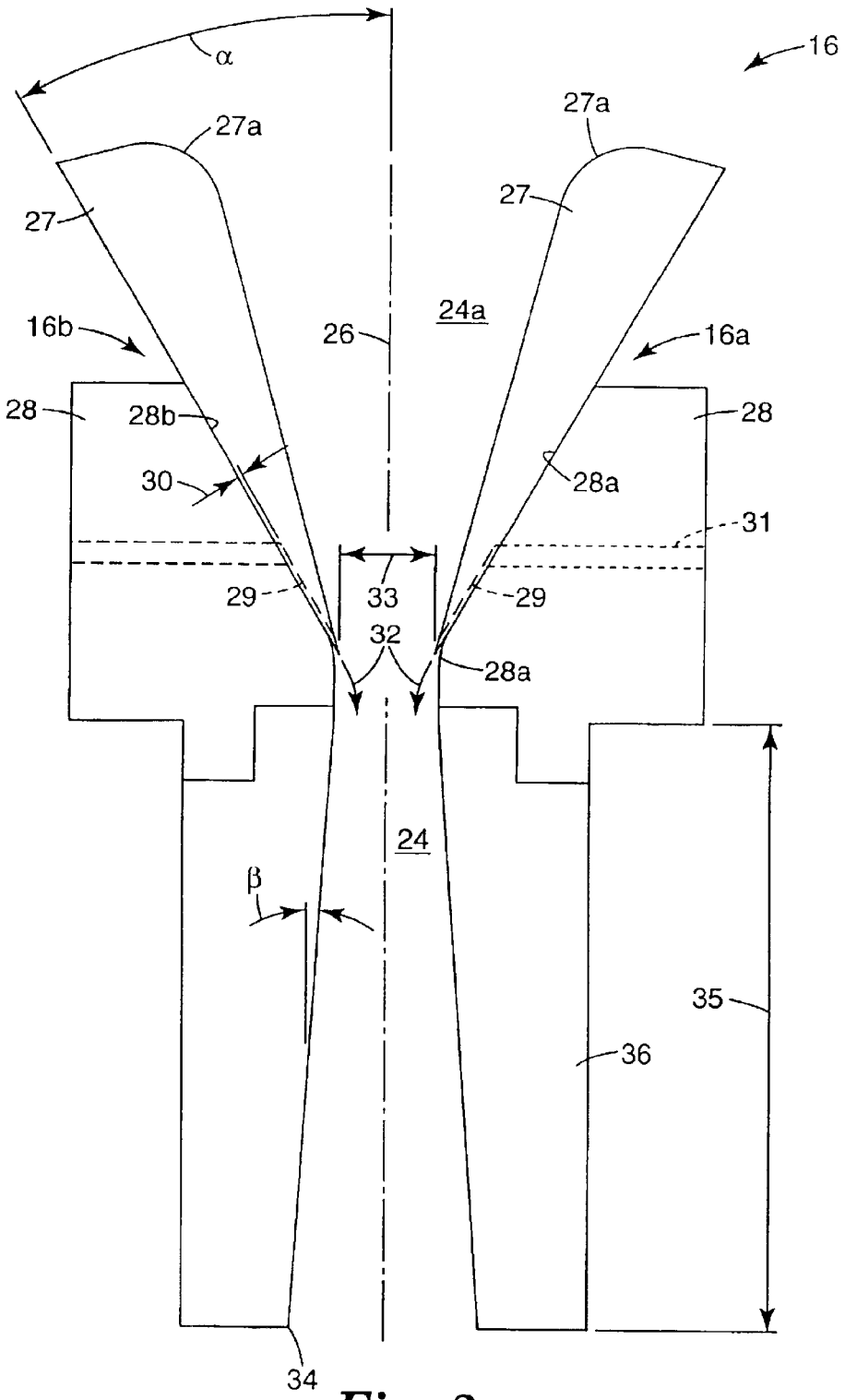
FIG. 2 is an enlarged side view of a processing chamber useful in the invention, with mounting means for the chamber not shown.
Figure 3:
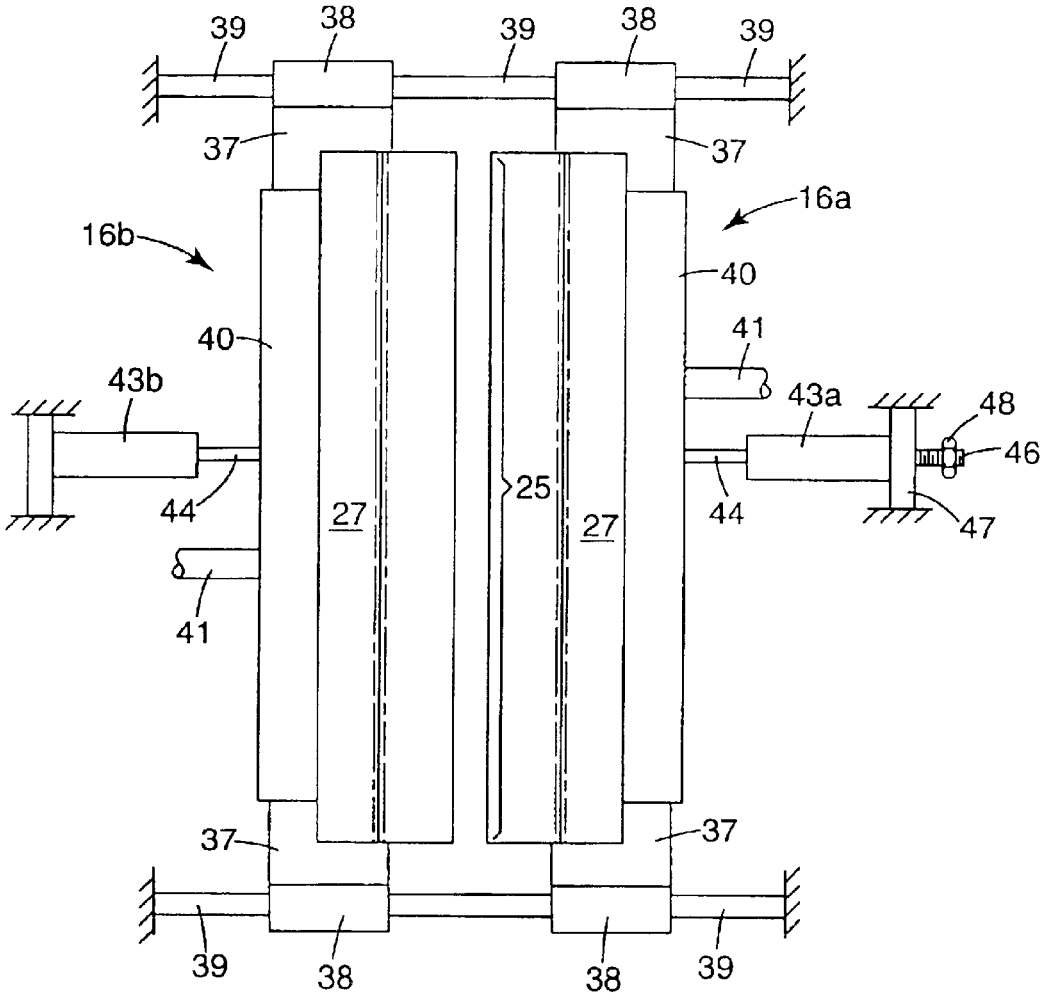
FIG. 3 is a top view, partially schematic, of the processing chamber shown in FIG. 2 together with mounting and other associated apparatus.

FIG. 2 is an enlarged side view of a representative processing device, namely an attenuator 16, which comprises two movable halves or sides 16*a* and 16*b* separated so as to define between them the processing chamber 24: the facing surfaces of the sides 16*a* and 16*b* form the walls of the chamber. FIG. 3 is a top and somewhat schematic view at a different scale showing the representative attenuator 16 and some of its mounting and support structure. As seen from the top view in FIG. 3, the processing or attenuation chamber 24 is generally an elongated slot, having a transverse length 25 (transverse to the path of travel of filaments through the attenuator), which can vary depending on the number of filaments being processed.

Although existing as two halves or sides, the attenuator functions as one unitary device and will be first discussed in its combined form. (The structure shown in FIGS. 2 and 3 is representative only, and a variety of different constructions may be used.) The representative attenuator 16 includes slanted entry walls 27, which define an entrance space or throat 24*a* of the attenuation chamber 24. The entry walls 27 preferably are curved at the entry edge or surface 27*a* to smooth the entry of air streams carrying the extruded filaments 15. The walls 27 are attached to a main body portion 28, and may be provided with a recessed area 29 to establish a gap 30 between the body portion 28 and wall 27. Air may be introduced into the gaps 30 through conduits 31, creating air knives (represented by the arrows 32) that increase the velocity of the filaments traveling through the attenuator, and that also have a further quenching effect on the filaments. The attenuator body 28 is preferably curved at 28*a* to smooth the passage of air from the air knife 32 into the passage 24. The angle ($\alpha$) of the surface 28*b* of the attenuator body can be selected to determine the desired angle at which the air knife impacts a stream of filaments passing through the attenuator. Instead of being near the entry to the chamber, the air knives may be disposed further within the chamber.

The attenuation chamber 24 may have a uniform gap width (the horizontal distance 33 on the page of FIG. 2 between the two attenuator sides is herein called the gap width) over its longitudinal length through the attenuator (the dimension along a longitudinal axis 26 through the attenuation chamber is called the axial length). Alternatively, as illustrated in FIG. 2, the gap width may vary along the length of the attenuator chamber. Preferably, the attenuation chamber is narrower internally within the attenuator; e.g., as shown in FIG. 2, the gap width 33 at the location of the air knives is the narrowest width, and the attenuation chamber expands in width along its length toward the exit opening 34, e.g., at an angle $\beta$. Such a narrowing internally within the attenuation chamber 24, followed by a broadening, creates a venturi effect that increases the volume of air inducted into the chamber and adds to the velocity of filaments traveling through the chamber. In a different embodiment, the attenuation chamber is defined by straight or flat walls; in such embodiments the spacing between the walls may be constant over their length, or alternatively the walls may slightly diverge (preferred) or converge over the axial length of the attenuation chamber. In all these cases, the walls defining the attenuation chamber are regarded as parallel herein, because the deviation from exact parallelism is relatively slight. As illustrated in FIG. 2, the walls defining the main portion of the longitudinal length of the passage 24 may take the form of plates 36 that are separate from, and attached to, the main body portion 28.

The length of the attenuation chamber 24 can be varied to achieve different effects; variation is especially useful with the portion between the air knives 32 and the exit opening 34, sometimes called herein the chute length 35. The angle between the chamber walls and the axis 26 may be wider near the exit 34 to change the distribution of fibers onto the collector; or structure such as deflector surfaces, Coanda curved surfaces, and uneven wall lengths may be used at the exit to achieve a desired spreading or other distribution of fibers. In general, the gap width, chute length, attenuation chamber shape, etc. are chosen in conjunction with the material being processed and the mode of treatment desired to achieve desired effects. For example, longer chute lengths may be useful to increase the crystallinity of prepared fibers. Conditions are chosen and can be widely varied to process the extruded filaments into a desired fiber form.

As illustrated in FIG. 3, the two sides 16*a* and 16*b* of the representative attenuator 16 are each supported through mounting blocks 37 attached to linear bearings 38 that slide on rods 39. The bearing 38 has a low-friction travel on the rod through means such as axially extending rows of ball-bearings disposed radially around the rod, whereby the sides 16*a* and 16*b* can readily move toward and away from one another. The mounting blocks 37 are attached to the attenuator body 28 and a housing 40 through which air from a supply pipe 41 is distributed to the conduits 31 and air knives 32.

In this illustrative embodiment, air cylinders 43*a* and 43*b* are connected, respectively, to the attenuator sides 16*a* and 16*b* through connecting rods 44 and apply a clamping force pressing the attenuator sides 16*a* and 16*b* toward one another. The clamping force is chosen in conjunction with the other operating parameters so as to balance the pressure existing within the attenuation chamber 24. In other words, the clamping force and the force acting internally within the attenuation chamber to press the attenuator sides apart as a result of the gaseous pressure within the attenuator are in balance or equilibrium under preferred operating conditions. Filamentary material can be extruded, passed through the attenuator and collected as finished fibers while the attenuator parts remain in their established equilibrium or steady-state position and the attenuation chamber or passage 24 remains at its established equilibrium or steady-state gap width.

During operation of the representative apparatus illustrated in FIGS. 1–3, movement of the attenuator sides or chamber walls generally occurs only when there is a perturbation of the system. Such a perturbation may occur when a filament being processed breaks or tangles with another filament or fiber. Such breaks or tangles are often accompanied by an increase in pressure within the attenuation chamber 24, e.g., because the forward end of the filament coming from the extrusion head or the tangle is enlarged and creates a localized blockage of the chamber 24. The increased pressure is sufficient to force the attenuator sides or chamber walls 16*a* and 16*b* to move away from one another. Upon this movement of the chamber walls the end of the incoming filament or the tangle can pass through the attenuator, whereupon the pressure in the attenuation chamber 24 returns to its steady-state value before the perturbation, and the clamping pressure exerted by the air cylinders 43 returns the attenuator sides to their steady-state position. Other perturbations causing an increase in pressure in the attenuation chamber include "drips," i.e., globular liquid pieces of fiber-forming material falling from the exit of the extrusion head upon interruption of an extruded filament, or accumulations of extruded filamentary material that may engage and stick to the walls of the attenuation chamber or to previously deposited fiber-forming material.

In effect, one or both of the attenuator sides 16*a* and 16*b* "float," i.e., are not held in place by any structure but instead are mounted for a free and easy movement laterally in the direction of the arrows 50 in FIG. 1. In a preferred arrangement, the only forces acting on the attenuator sides other than friction and gravity are the biasing force applied by the air cylinders and the internal pressure developed within the attenuation chamber 24. Other clamping means than the air cylinder may be used, such as a spring(s), deformation of an elastic material, or cams; but the air cylinder offers a desired control and variability.

Many alternatives are available to cause or allow a desired movement of the processing chamber wall(s), which as noted above, is an instantaneous movement. For example, instead of relying on fluid pressure to force the wall(s) of the processing chamber apart, a sensor within the chamber (e.g., a laser or thermal sensor detecting buildup on the walls or plugging of the chamber) may be used to activate a servomechanical mechanism that separates the wall(s) and then returns them to their steady-state position. In another useful apparatus of the invention, one or both of the attenuator sides or chamber walls is driven in an oscillating pattern, e.g., by a servomechanical, vibratory or ultrasonic driving device. The rate of oscillation can vary within wide ranges, including, for example, at least rates of 5,000 cycles per minute to 60,000 cycles per second.

In still another variation, the movement means for both separating the walls and returning them to their steady-state position takes the form simply of a difference between the fluid pressure within the processing chamber and the ambient pressure acting on the exterior of the chamber walls. More specifically, during steady-state operation, the pressure within the processing chamber (a summation of the various forces acting within the processing chamber established, for example, by the internal shape of the processing chamber, the presence, location and design of air knives, the velocity of a fluid stream entering the chamber, etc.) is in balance with the ambient pressure acting on the outside of the chamber walls. If the pressure within the chamber increases because of a perturbation of the fiber-forming process, one or both of the chamber walls moves away from the other wall until the perturbation ends, whereupon pressure within the processing chamber is reduced to a level less than the steady-state pressure (because the gap width between the chamber walls is greater than at the steady-state operation). Thereupon, the ambient pressure acting on the outside of the chamber walls forces the chamber wall(s) back until the pressure within the chamber is in balance with the ambient pressure, and steady-state operation occurs. Lack of control over the apparatus and processing parameters can make sole reliance on pressure differences a less desired option.

In sum, besides being instantaneously movable and in some cases "floating," the wall(s) of the processing chamber are also generally subject to means for causing them to move in a desired way. The walls can be thought of as generally connected, e.g., physically or operationally, to means for causing a desired movement of the walls. The movement means may be any feature of the processing chamber or associated apparatus, or an operating condition, or a combination thereof that causes the intended movement of the movable chamber walls—movement apart, e.g., to prevent or alleviate a perturbation in the fiber-forming process, and movement together, e.g., to establish or return the chamber to steady-state operation.

In the embodiment illustrated in FIGS. 1–3, the gap width 33 of the attenuation chamber 24 is interrelated with the pressure existing within the chamber, or with the fluid flow rate through the chamber and the fluid temperature. The clamping force matches the pressure within the attenuation chamber and varies depending on the gap width of the attenuation chamber: for a given fluid flow rate, the narrower the gap width, the higher the pressure within the attenuation chamber, and the higher must be the clamping force. Lower clamping forces allow a wider gap width. Mechanical stops, e.g., abutting structure on one or both of the attenuator sides 16*a* and 16*b* may be used to assure that minimum or maximum gap widths are maintained.

In one useful arrangement, the air cylinder 43*a* applies a larger clamping force than the cylinder 43*b*, e.g., by use in cylinder 43*a* of a piston of larger diameter than used in cylinder 43*b*. This difference in force establishes the attenuator side 16*b* as the side that tends to move most readily when a perturbation occurs during operation. The difference in force is about equal to and compensates for the frictional forces resisting movement of the bearings 38 on the rods 39. Limiting means can be attached to the larger air cylinder 43*a* to limit movement of the attenuator side 16*a* toward the attenuator side 16*b*. One illustrative limiting means, as shown in FIG. 3, uses as the air cylinder 43*a* a double-rod air cylinder, in which the second rod 46 is threaded, extends through a mounting plate 47, and carries a nut 48 which may be adjusted to adjust the position of the air cylinder. Adjustment of the limiting means, e.g., by turning the nut 48, positions the attenuation chamber 24 into alignment with the extrusion head 10.

Because of the described instantaneous separation and reclosing of the attenuator sides 16*a* and 16*b*, the operating parameters for a fiber-forming operation are expanded. Some conditions that would previously make the process inoperable—e.g., because they would lead to filament breakage requiring shutdown for rethreading—become acceptable with a method and apparatus of the invention; upon filament breakage, rethreading of the incoming filament end generally occurs automatically. For example, higher velocities that lead to frequent filament breakage may be used. Similarly, narrow gap widths, which cause the air knives to be more focused and to impart more force and greater velocity on filaments passing through the attenuator, may be used. Or filaments may be introduced into the attenuation chamber in a more molten condition, thereby allowing greater control over fiber properties, because the danger of plugging the attenuation. chamber is reduced. The attenuator may be moved closer to or further from the extrusion head to control among other things the temperature of the filaments when they enter the attenuation chamber.

Although the chamber walls of the attenuator 16 are shown as generally monolithic structures, they can also take the form of an assemblage of individual parts each mounted for the described instantaneous or floating movement. The individual parts comprising one wall engage one another through sealing means so as to maintain the internal pressure within the processing chamber 24. In a different arrangement, flexible sheets of a material such as rubber or plastic form the walls of the processing chamber 24, whereby the chamber can deform locally upon a localized increase in pressure (e.g., because of a plugging caused by breaking of a single filament or group of filaments). A series or grid of biasing means may engage the segmented or flexible wall; sufficient biasing means are used to respond to localized deformations and to bias a deformed portion of the wall back to its undeformed position. Alternatively, a series or grid of oscillating means may engage the flexible wall and oscillate local areas of the wall. Or, in the manner discussed above, a difference between the fluid pressure within the processing chamber and the ambient pressure acting on the wall or localized portion of the wall may be used to cause opening of a portion of the wall(s), e.g., during a process perturbation, and to return the wall(s) to the undeformed or steady-state position, e.g., when the perturbation ends. Fluid pressure may also be controlled to cause a continuing state of oscillation of a flexible or segmented wall.

As will be seen, in the preferred embodiment of processing chamber illustrated in FIGS. 2 and 3, there are no side walls at the ends of the transverse length of the chamber. The result is that fibers passing through the chamber can spread outwardly outside the chamber as they approach the exit of the chamber. Such a spreading can be desirable to widen the mass of fibers collected on the collector. In other embodiments, the processing chamber does include side walls, though a single side wall at one transverse end of the chamber is not attached to both chamber sides 16*a* and 16*b*, because attachment to both chamber sides would prevent separation of the sides as discussed above. Instead, a sidewall(s) may be attached to one chamber side and move with that side when and if it moves in response to changes of pressure within the passage. In other embodiments, the side walls are divided, with one portion attached to one chamber side, and the other portion attached to the other chamber side, with the sidewall portions preferably overlapping if it is desired to confine the stream of processed fibers within the processing chamber.

A wide variety of fiber-forming materials may be used to make fibers with a method and apparatus of the invention. Either organic polymeric materials, or inorganic materials, such as glass or ceramic materials, may be used. While the invention is particularly useful with fiber-forming materials in molten form, other fiber-forming liquids such as solutions or suspensions may also be used. Any fiber-forming organic polymeric materials may be used, including the polymers commonly used in fiber formation such as polyethylene, polypropylene, polyethylene terephthalate, nylon, and urethanes. Some polymers or materials that are more difficult to form into fibers by spunbond or meltblown techniques can be used, including amorphous polymers such as cyclic olefins (which have a high melt viscosity that limits their utility in conventional direct-extrusion techniques), block copolymers, styrene-based polymers, and adhesives (including pressure-sensitive varieties and hot-melt varieties). The specific polymers listed here are examples only, and a wide variety of other polymeric or fiber-forming materials are useful. Interestingly, fiber-forming processes of the invention using molten polymers can often be performed at lower temperatures than traditional direct extrusion techniques, which offers a number of advantages.

Fibers also may be formed from blends of materials, including materials into which certain additives have been blended, such as pigments or dyes. Bicomponent fibers, such as core-sheath or side-by-side bicomponent fibers, may be prepared ("bicomponent" herein includes fibers with more than two components). In addition, different fiber-forming materials may be extruded through different orifices of the extrusion head so as to prepare webs that comprise a mixture of fibers. In other embodiments of the invention other materials are introduced into a stream of fibers prepared according to the invention before or as the fibers are collected so as to prepare a blended web. For example, other staple fibers may be blended in the manner taught in U.S. Pat. No. 4,118,531; or particulate material may be introduced and captured within the web in the manner taught in U.S. Pat. No. 3,971,373; or microwebs as taught in U.S. Pat. No. 4,813,948 may be blended into the webs. Alternatively, fibers prepared by the present invention may be introduced into a stream of other fibers to prepare a blend of fibers.

A fiber-forming process of the invention can be controlled to achieve different effects and different forms of web. For example, a process of the invention can be controlled to control the solidity of filaments entering the processing chamber (e.g., by moving the processing chamber closer to or further from the extrusion head, or increasing or decreasing the volume or the temperature of quenching fluids). In some cases at least a majority of the extruded filaments of fiber-forming material solidify before entering the processing chamber. Such solidification changes the nature of the action of the air impacting the filaments in the processing chamber and the effects within the filaments, and changes the nature of the collected web. In other processes of the invention the process is controlled so that at least a majority of the filaments solidify after they enter the processing chamber, whereupon they may solidify within the chamber or after they exit the chamber. Sometimes the process is controlled so that at least a majority of the filaments or fibers solidify after they are collected, so the fibers are sufficiently molten that when collected they may become adhered at points of fiber intersection.

A wide variety of web properties may be obtained by varying the process. For example, when the fiber-forming material has essentially solidified before it reaches the attenuator, the web will be more lofty and exhibit less or no interfiber bonding. By contrast, when the fiber-forming material is still molten at the time it enters the attenuator, the fibers may still be soft when collected so as to achieve interfiber bonding.

The invention has the advantage that filaments may be processed at very fast velocities not known to be previously available in direct-web-formation processes that use a processing chamber in the same role as the typical role of a processing chamber of the present invention, i.e., to provide primary attenuation of extruded filamentary material. For example, polypropylene is not known to have been processed at apparent filament speeds of 8000 meters per minute in processes that use such a processing chamber, but such apparent filament speeds are possible with the present invention (the term apparent filament speed is used, because the speeds are calculated, e.g., from polymer flow rate, polymer density, and average fiber diameter). Even faster apparent filament speeds have been achieved, e.g., 10,000 meters per minute, or even 14,000 or 18,000 meters per minute, and these speeds can be obtained with a wide range of polymers. In addition, large volumes of polymer can be processed per orifice in the extrusion head, and these large volumes can be processed while at the same time moving extruded filaments at high velocity. This combination gives rise to a high productivity index—the rate of polymer throughput (e.g., in grams per orifice per minute) multiplied by the apparent velocity of extruded filaments (e.g., in meters per minute). The process of the invention can be readily practiced with a productivity index of 9000 or higher, even while producing filaments that average 20 micrometers or less in diameter.

Various processes conventionally used as adjuncts to fiber-forming processes may be used in connection with filaments as they enter or exit from the attenuator, such as spraying of finishes or other materials onto the filaments, application of an electrostatic charge to the filaments, application of water mists, etc. In addition, various materials may be added to a collected web, including bonding agents, adhesives, finishes, and other webs or films.

Although there typically is no reason to do so, filaments may be blown from the extrusion head by a primary gaseous stream in the manner of that used in conventional meltblowing operations. Such primary gaseous streams cause an initial attenuation and drawing of the filaments.

The fibers prepared by a method of the invention may range widely in diameter. Microfiber sizes (about 10 micrometers or less in diameter) may be obtained and offer several benefits; but fibers of larger diameter can also be prepared and are useful for certain applications; often the fibers are 20 micrometers or less in diameter. Fibers of circular cross-section are most often prepared, but other cross-sectional shapes may also be used. Depending on the operating parameters chosen, e.g., degree of solidification from the molten state before entering the attenuator, the collected fibers may be rather continuous or essentially discontinuous. The orientation of the polymer chains in the fibers can be influenced by selection of operating parameters, such as degree of solidification of filament entering the attenuator, velocity and temperature of air stream introduced into the attenuator by the air knives, and axial length, gap width and shape (because, for example, shape influences the venturi effect) of the attenuator passage.

Unique fibers and fiber properties, and unique fibrous webs, have been achieved by the invention. For example, in some collected webs, fibers are found that are interrupted, i.e., are broken, or entangled with themselves or other fibers, or otherwise deformed as by engaging a wall of the processing chamber. The fiber segments at the location of the interruption—i.e., the fiber segments at the point of a fiber break, and the fiber segments in which an entanglement or deformation occurs—are all termed an interrupting fiber segment herein, or more commonly for shorthand purposes, are often simply termed "fiber ends": these interrupting fiber segments form the terminus or end of an unaffected length of fiber, even though in the case of entanglements or deformations there often is no actual break or severing of the fiber. The fiber ends have a fiber form (as opposed to a globular shape as sometimes obtained in meltblowing or other previous methods) but are usually enlarged in diameter over the intermediate portions of the fiber; usually they are less than 300 micrometers in diameter. Often, the fiber ends, especially broken ends, have a curly or spiral shape, which causes the ends to entangle with themselves or other fibers. And the fiber ends may be bonded side-by-side with other fibers, e.g., by autogenous coalescing of material of the fiber end with material of an adjacent fiber.

Figure 4:
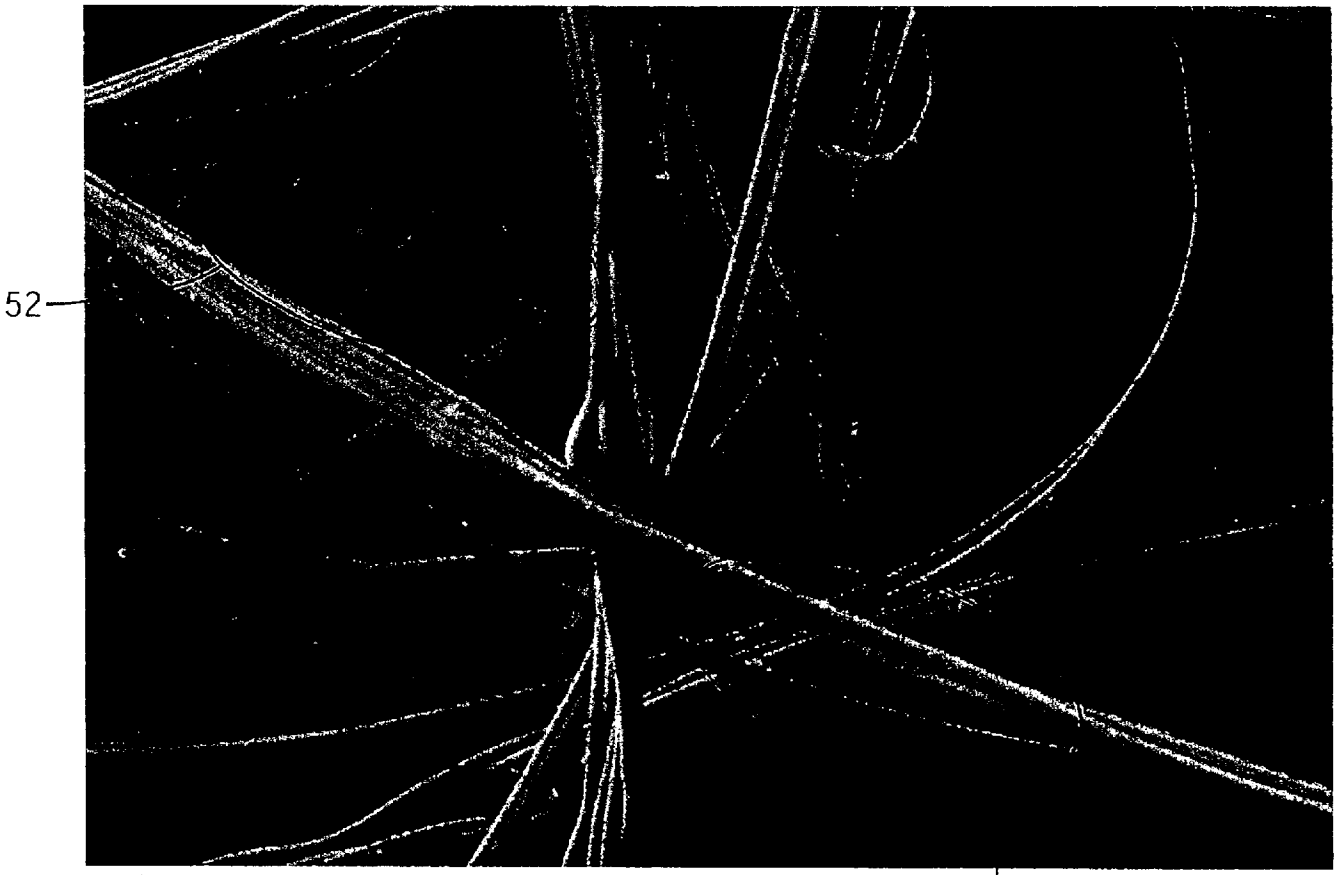
FIG. 4 is a scanning electron micrograph of a web prepared in Example 5.

FIG. 4 is a scanning electron micrograph at 150× enlargement of a polypropylene fibrous web prepared in Example 5. As seen, the web includes fiber ends 52, which though in fibrous form, have a larger diameter than intermediate or middle portions 53. The interrupting fiber segments, or fiber ends, generally occur in a minor amount. The main portion of the fibers is unaffected (for shorthand purposes, the unaffected main portions of fibers are termed the "middles" herein). Also, the interruptions are isolated and random, i.e., they do not occur in a regular repetitive or predetermined manner.

Fiber ends as described arise because of the unique character of the fiber-forming process of the invention, which continues in spite of breaks and interruptions in individual fiber formation. Such fiber ends may not occur in all collected webs of the invention, but do occur at least at some useful operating process parameters (for example, they may not occur if the extruded filaments of fiber-forming material have reached a high degree of solidification before they enter the processing chamber). Individual fibers may be subject to an interruption, e.g., may break while being drawn in the processing chamber, or may entangle with themselves or another fiber as a result of being deflected from the wall of the processing chamber or as a result of turbulence within the processing chamber, perhaps while still molten: but notwithstanding such interruption, the fiber-forming process of the invention continues. The result is that the collected web includes a significant and detectable number of the fiber ends, or interrupting fiber segments where there is a discontinuity in the fiber. Since the interruption typically occurs in or after the processing chamber, where the fibers are typically subjected to drawing forces, the fibers are under tension when they break, entangle or deform. The break, or entanglement generally results in an interruption or release of tension allowing the fiber ends to retract and gain in diameter. Also, broken ends are free to move within the fluid currents in the processing chamber, which at least in some cases leads to winding of the ends into a spiral shape and entangling with other fibers.

Analytical study and comparisons of the fiber ends and middle portions, such as the portions 52 and 53 in FIG. 4, typically reveals a different morphology between the ends and middles. The polymer chains in the fiber ends usually are oriented, but not to the degree they are oriented in the middle portions of the fibers. This difference in orientation can result in a difference in the proportion of crystallinity and in the kind of crystalline or other morphological structure. And these differences are reflected in different properties.

Figure 5:
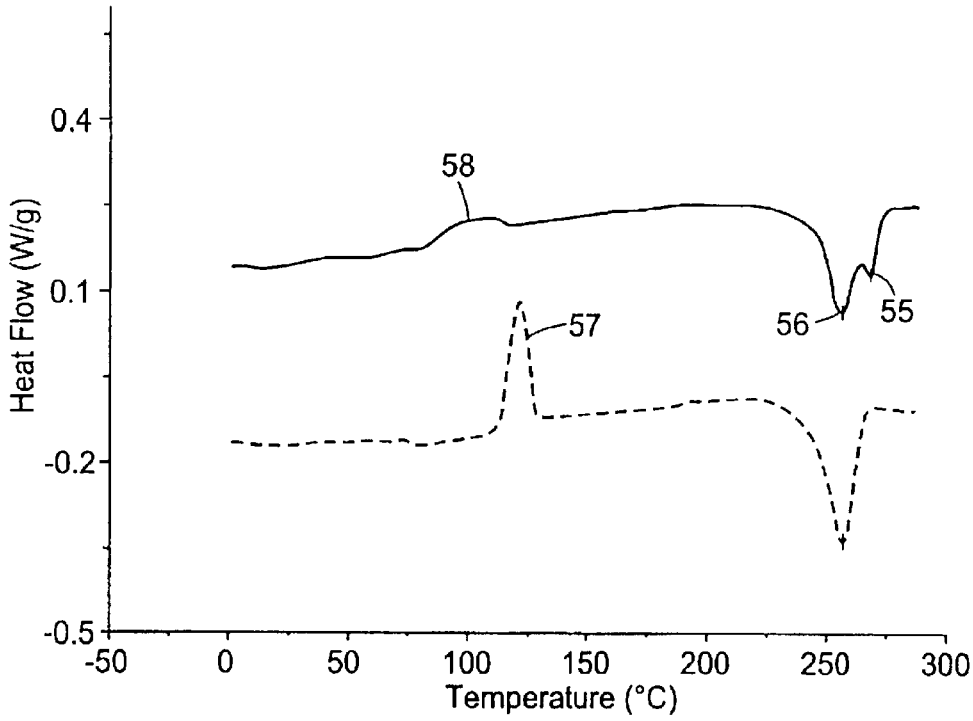
FIGS. 5, 6, 7 and 7*a* are plots obtained by differential scanning calorimetry on various exemplary webs of the invention.
Figure 6:
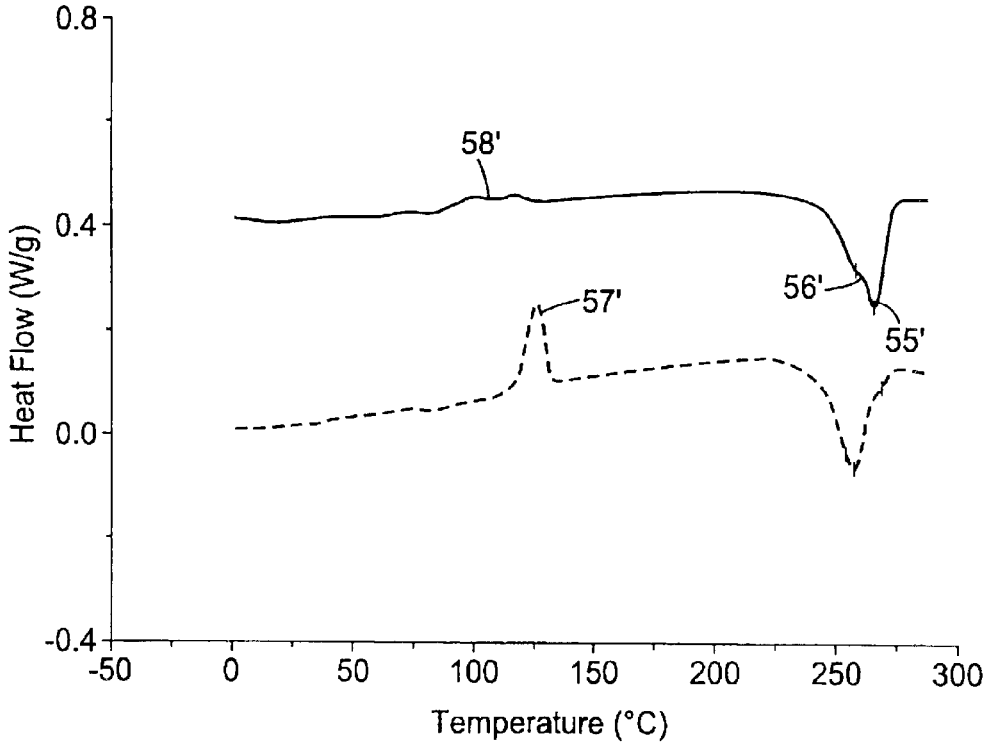

FIGS. 5 and 6 present plots obtained by differential scanning calorimetry (DSC) for representative fibers and fiber ends of PET webs prepared in Examples 27 and 29, respectively. The solid-line plots are for intermediate or middle portions of a fiber and the dotted-line plots are for fiber ends. The solid-line plots show a dual melting peak, points 55 and 56 on FIG. 5, and points 55' and 56' on FIG. 6. The higher-temperature peak, 55 and 55', shows the melting point for a chain-extended, or strain-induced, crystalline portion; and the other peak, 56 and 56', shows the melting point for a non-chain-extended, or less-ordered, crystalline portion. (The term "peak" herein means that portion of a heating curve that is attributable to a single process, e.g., melting of a specific molecular portion of a fiber such as a chain-extended portion; sometimes peaks are sufficiently close to one another that one peak has the appearance of a shoulder of the curve defining the other peak, but they are still regarded as separate peaks, because they represent melting points of distinct molecular fractions.) The existence of a chain-extended crystalline portion generally means that the fibers have superior properties such as tensile strength, durability, and dimensional stability.

From a comparison of the solid-line and dotted-line plots it is seen that in the tested sample the fiber ends, represented by the dotted-line plots, have a lower melting point than the middle portions of the fibers; such a difference in melting point occurs because of a difference between the middles and ends in crystalline structure and orientation. Also, in the tested sample the fiber ends have a higher cold-crystallization peak (the point 57 and 57' in FIGS. 5 and 6, respectively; crystallization of an amorphous or semicrystalline material upon heating is called cold crystallization), signifying that the fiber ends contain more amorphous or semicrystalline material, and less highly ordered crystalline material than in the middle portions. The middle portions exhibit cold crystallization, by the peaks 58 and 58', but over a wider and different temperature range than the fiber ends.

Figure 7:
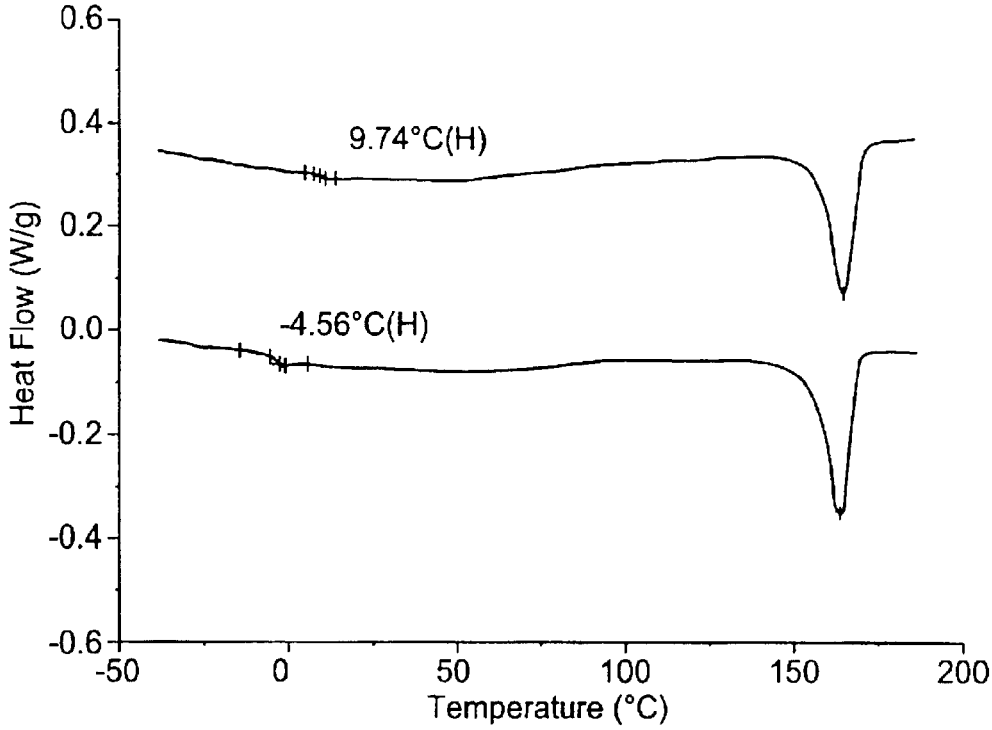
Figure 7A:
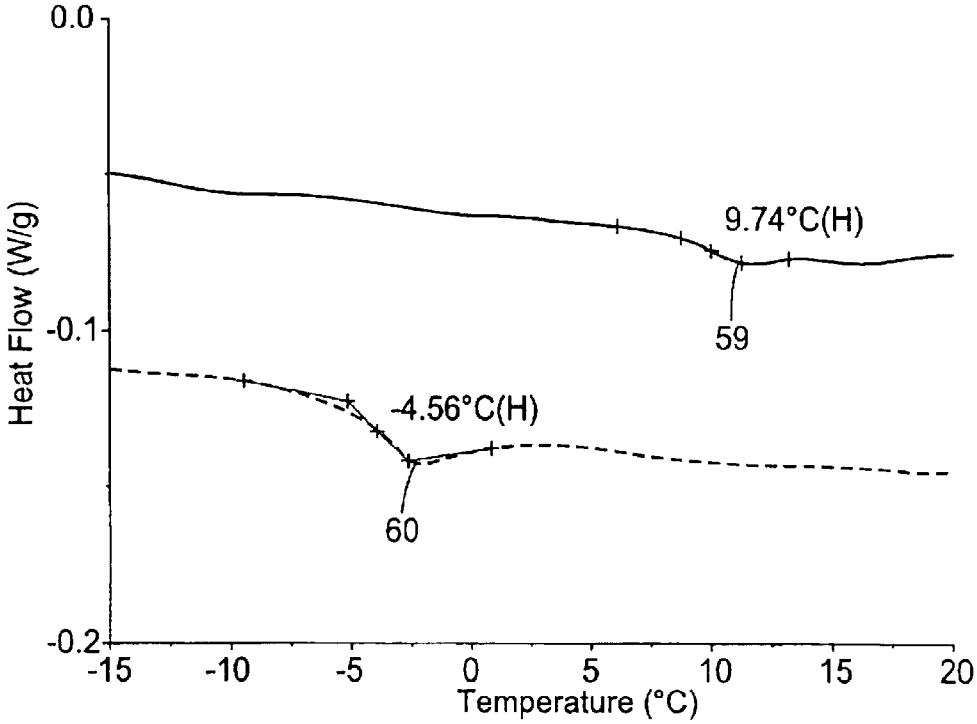

A difference in glass transition temperature ($T_g$) between fiber ends and fiber middles is also often noted during thermal analysis. This difference is more clearly shown in FIGS. 7 and 7*a*, which are plots for the middles (solid-line) and ends (dotted-line) for another sample, namely Example 16; FIG. 7*a* is an enlarged view of a portion of the plots on which $T_g$ occurs. The $T_g$ for the middles, point 59, is 9.74 degrees C., while the $T_g$ for the ends, point 60, is −4.56 degrees C.

In general, when fiber middles and ends prepared by this invention are evaluated using a properly calibrated differential scanning calorimeter (DSC), the fiber middles and ends will differ from each other as to one or more of the common thermal transitions by at least the resolution of the testing instrument (0.1° C.), due to the differences in the mechanisms operating internally within the fiber middles and fiber ends. For example, when experimentally observable, the thermal transitions can differ as follows: 1) the glass transition temperature, $T_g$, for middles can be slightly higher in temperature than for ends, and the feature can diminish in height as crystalline content or orientation in the fiber middle increases; 2) when observed, the onset temperature of cold crystallization, $T_c$, and the peak area measured during cold crystallization will be lower for the fiber middle portion relative to the fiber ends, and finally, 3) the melting peak temperature, $T_m$, for the fiber middles will either be elevated over the $T_m$ observed for the ends, or become complex in nature showing multiple endothermic minima (i.e., multiple melting peaks representing different melting points for different molecular portions that, for example, differ in the order of their crystalline structure), with one molecular portion of the middle portion of the fiber melting at a higher temperature than molecular portions of the fiber ends. Most often, fiber ends and fiber middles differ in one or more of the parameters glass transition temperature, cold crystallization temperature, and melting point by at least 0.5 or 1 degree C.

Webs including fibers with enlarged fibrous ends have the advantage that the fiber ends may comprise a more easily softened material adapted to increase bonding of a web; and the spiral shape can increase coherency of the web.

EXAMPLES

Apparatus as shown in FIG. 1 was used to prepare fibers from a number of different polymers as summarized in Table 1. Specific parts of the apparatus and operating conditions were varied as described below and as also summarized in Table 1. Table 1 also includes a description of characteristics of the fibers prepared.

Examples 1–22 and 42–43 were prepared from polypropylene; Examples 1–13 were prepared from a polypropylene having a melt flow index (MFI) of 400 (Exxon 3505G), Example 14 was prepared from polypropylene having a MFI of 30 (Fina 3868), Examples 15–22 were prepared from a polypropylene having a MFI of 70 (Fina 3860), and Examples 42–43 were prepared from a polypropylene having a MFI of 400 (Fina 3960). Polypropylene has a density of 0.91 g/cc.

Examples 23–32 and 44–46 were prepared from polyethylene terephthalate; Examples 23–26, 29–32 and 44 were prepared from PET having an intrinsic viscosity (IV) of 0.61 (3M 651000), Example 27 was prepared from PET having an IV of 0.36, Example 28 was prepared from PET having an IV of 0.9 (a high-molecular-weight PET useful as a high-tenacity spinning fiber supplied as Crystar 0400 supplied by Dupont Polymers), and Examples 45 and 46 were prepared from PETG (AA45-004 made by Paxon Polymer Company, Baton Rouge, La.). PET has a density of 1.35 and PETG has a density of about 1.30.

Examples 33 and 41 were prepared from a nylon 6 polymer (Ultramid PA6 B-3 from BASF) having an MFI of 130 and a density of 1.15. Example 34 was prepared from polystyrene (Crystal PS 3510 supplied by Nova Chemicals) and having an MFI of 15.5 and density of 1.04. Example 35 was prepared from polyurethane (Morton PS-440-200) having a MFI of 37 and density of 1.2. Example 36 was prepared from polyethylene (Dow 6806) having a MFI of 30 and density of 0.95. Example 37 was prepared from a block copolymer comprising 13 percent styrene and 87 percent ethylene butylene copolymer (Shell Kraton G1657) having a MFI of 8 and density of 0.9.

Example 38 was a bicomponent core-sheath fiber having a core (89 weight percent) of the polystyrene used in Example 34 and a sheath (11 weight percent) of the copolymer used in Example 37. Example 39 was a bicomponent side-by-side fiber prepared from polyethylene (Exxact 4023 supplied by Exxon Chemicals having a MFI of 30); 36 weight percent) and a pressure-sensitive adhesive 64 weight percent). The adhesive comprised a terpolymer of 92 weight percent isooctylacrylate, 4 weight percent styrene, and 4 weight percent acrylic acid, had an intrinsic viscosity of 0.63, and was supplied through a Bonnot adhesive extruder.

In Example 40 each fiber was single-component, but fibers of two different polymer compositions were used—the polyethylene used in Example 36 and the polypropylene used in Examples 1–13. The extrusion head had four rows of orifices, with 42 orifices in each row; and the supply to the extrusion head was arranged to supply a different one of the two polymers to adjacent orifices in a row to achieve an A-B-A . . . pattern.

In Example 47 a fibrous web was prepared solely from the pressure-sensitive adhesive that was used as one component of bicomponent fibers in Example 39; a Bonnot adhesive extruder was used.

In Examples 42 and 43 the air cylinders used to bias the movable sides or walls of the attenuator were replaced with coil springs. In Example 42, the springs deflected 9.4 millimeters on each side during operation in the example. The spring constant for the spring was 4.38 Newtons/millimeter so the clamping force applied by each spring was 41.1 Newtons. In Example 43, the spring deflected 2.95 millimeters on each side, the spring constant was 4.9 Newtons/millimeter, and the clamping force was 14.4 Newtons.

In Example 44 the extrusion head was a meltblowing die, which had 0.38-millimeter-diameter orifices spaced 1.02 millimeters center to center. The row of orifices was 101.6 millimeters long. Primary meltblowing air at a temperature of 370 degrees C. was introduced through a 203-millimeter-wide air knife on each side of the row of orifices at a rate of 0.45 cubic meters per minute (CMM) for the two air knives in combination.

In Example 47 pneumatic rotary ball vibrators oscillating at about 200 cycles per second were connected to each of the movable attenuator sides or walls; the air cylinders remained in place and aligned the attenuator chamber under the extrusion head and were available to return the attenuator sides to their original position in the event a pressure buildup forced the sides apart. During operation of the example, a lesser quantity of pressure-sensitive adhesive stuck onto the attenuator walls when the vibrators were operating than when they were not operating. In Examples 7 and 37 the clamping force was zero, but the balance between air pressure within the processing chamber and ambient pressure established the gap between chamber walls and returned the moveable side walls to their original position after any perturbations.

In each of the examples the polymer formed into fibers was heated to a temperature listed in Table 1 (temperature measured in the extruder 12 near the exit to the pump 13), at which the polymer was molten, and the molten polymer was supplied to the extrusion orifices at a rate as listed in the table. The extrusion head generally had four rows of orifices, but the number of orifices in a row, the diameter of the orifices, and the length-to-diameter ratio of the orifices were varied as listed in the table. In Examples 1–2, 5–7, 14–24, 27, 29–32, 34, and 36–40 each row had 42 orifices, making a total of 168 orifices. In the other examples with the exception of Example 44, each row had 21 orifices, making a total of 84 orifices.

The attenuator parameters were also varied as described in the table, including the air knife gap (the dimension 30 in FIG. 2 ); the attenuator body angle ($\alpha$ in FIG. 2); the temperature of the air passed through the attenuator; quench air rate; the clamping pressure and force applied to the attenuator by the air cylinders; the total volume of air passed through the attenuator (given in actual cubic meters per minute, or ACMM; about half of the listed volume was passed through each air knife 32); the gaps at the top and bottom of the attenuator (the dimensions 33 and 34, respectively, in FIG. 2); the length of the attenuator chute (dimension 35 in FIG. 2); the distance from the exit edge of the die to the attenuator (dimension 17 in FIG. 2); and the distance from the attenuator exit to the collector (dimension 21 in FIG. 2). The air knife had a transverse length (the direction of the length 25 of the slot in FIG. 3) of about 120 millimeters; and the attenuator body 28 in which the recess for the air knife was formed had a transverse length of about 152 millimeters. The transverse length of the wall 36 attached to the attenuator body was varied: in Examples 1–5, 8–28, 33–35, and 37–47, the transverse length of the wall was 254 millimeters; in Example 6, 26, 29–32 and 36 it was about 406 millimeters; and in Example 7 it was about 152 millimeters.

Properties of the collected fibers are reported including the average fiber diameter, measured from digital images acquired from a scanning electron microscope and using an image analysis program UTHSCSA IMAGE Tool for Windows, version 1.28, from the University of Texas Health Science Center in San Antonio (copyright 1995–97). The images were used at magnifications of 500 to 1000 times, depending on the size of the fibers.

The apparent filament speed of the collected fibers was calculated from the equation, $$V_{apparent}=4M/\rho\pi d_f^2,$$

where

M is the polymer flow rate per orifice in grams/cubic meter, $\rho$ is the polymer density, and $d_f$ is the measured average fiber diameter in meters.

The tenacity and elongation to break of the fibers were measured by separating out a single fiber under magnification and mounting the fiber in a paper frame. The fiber was tested for breaking strength by the method outlined in ASTM D3822-90. Eight different fibers were used to determine an average breaking strength and an average elongation to break. Tenacity was calculated from the average breaking strength and the average denier of the fiber calculated from the fiber diameter and polymer density.

Samples were cut from the prepared webs, including portions comprising a fiber end, i.e., a fiber segment in which an interruption taking the form of either a break or an entanglement had occurred, and portions comprising the fiber middle, i.e., the main unaffected portion of the fibers, and the samples were submitted for analysis by differential scanning calorimetry, specifically Modulated DSC™ using a Model 2920 device supplied by TA Instruments Inc, New Castle, Del., and using a heating rate of 4 degrees C./minute, a perturbation amplitude of plus-or-minus 0.636 degrees C., and a period of 60 seconds. Melting points for both the fiber ends and the middles were determined; the maximum melting point peak on the DSC plots for the fiber middles and ends are reported in Table 1.

Although in some cases no difference between middles and ends was detected as to melting point, other differences were often seen even in those examples, such as differences in glass transition temperature.

The samples of fiber middles and ends were also submitted for X-ray diffraction analysis. Data were collected by use of a Bruker microdiffractometer (supplied by Bruker AXS, Inc. Madison, Wis.), copper $K_\alpha$ radiation, and HI-STAR 2D position sensitive detector registry of the scattered radiation. The diffractometer was fitted with a 300-micrometer collimator and graphite-incident-beam monochromator. The X-ray generator consisted of a rotating anode surface operated at settings of 50 kV and 100 mA and using a copper target. Data were collected using a transmission geometry for 60 minutes with the detector centered at 0 degrees ($2\theta$). Samples were corrected for detector sensitivity and spatial irregularities using the Bruker GADDS data analysis software. The corrected data were averaged azimuthally, reduced to x-y pairs of scattering angle ($2\theta$) and intensity values, and subjected to profile fitting by using the data analysis software ORIGIN™ (supplied by Microcal Software, Inc. Northhampton, Mass.) for evaluation of crystallinity.

A gaussian peak shape model was employed to describe the individual crystalline peak and amorphous peak contributions. For some data sets, a single amorphous peak did not adequately account for the total amorphous scattered intensity. In these cases additional broad maxima were employed to fully account for the observed amorphous scattered intensity. Crystallinity indices were calculated as the ratio of crystalline peak area to total scattered peak area (crystalline plus amorphous) within the 6-to-36 degree ($2\theta$) scattering angle range. A value of unity represents 100 percent crystallinity and a value of zero corresponds to a completely amorphous material. Values obtained are reported in Table 1.

As to five examples of webs made from polypropylene, Examples 1, 3, 13, 20 and 22, X-ray analysis revealed a difference between middles and ends in that the ends included a beta crystalline form, measured at 5.5 angstroms.

Draw area ratios were determined by dividing the cross-sectional area of the die orifice by the cross-sectional area of the completed fibers, calculated from the average fiber diameter. Productivity index was also calculated.

TABLE 1

| Example Number | | 1 | 2 | 3 | 4 | 5 | 6 | 7 | 8 | 9 | 10 |
|---|---|---|---|---|---|---|---|---|---|---|---|
| Polymer | | PP | PP | PP | PP | PP | PP | PP | PP | PP | PP |
| MFI/IV | | 400 | 400 | 400 | 400 | 400 | 400 | 400 | 400 | 400 | 400 |
| Melt Temperature | (C.) | 187 | 188 | 187 | 183 | 188 | 188 | 188 | 188 | 180 | 188 |
| Number of Orifices | | 168 | 168 | 84 | 84 | 168 | 168 | 168 | 84 | 84 | 84 |
| Polymer Flow Rate | (g/orifice/min) | 1.00 | 1.00 | 1.00 | 1.04 | 1.00 | 1.00 | 1.00 | 0.49 | 4.03 | 1.00 |

TABLE 1-continued

| | | | | | | | | | | | |
|---|---|---|---|---|---|---|---|---|---|---|---|
| Orifice Diameter | (mm) | 0.343 | 0.508 | 0.889 | 1.588 | 0.508 | 0.508 | 0.508 | 0.889 | 0.889 | 0.889 |
| Orifice L/D | | 9.26 | 6.25 | 3.57 | 1.5 | 6.25 | 6.25 | 6.25 | 3.57 | 3.57 | 3.57 |
| Air Knife Gap | (mm) | 0.762 | 0.762 | 0.762 | 0.762 | 0.762 | 0.762 | 0.762 | 0.381 | 1.778 | 0.381 |
| Attenuator Body Angle | (degrees) | 30 | 30 | 30 | 30 | 30 | 30 | 30 | 20 | 40 | 20 |
| Attenuator Air Temperature | (C.) | 25 | 25 | 25 | 25 | 25 | 25 | 25 | 25 | 25 | 25 |
| Quench Air Rate | (ACMM) | 0.44 | 0.35 | 0.38 | 0.38 | 0.38 | 0.37 | 0 | 0.09 | 0.59 | 0.26 |
| Clamping Force | (Newtons) | 221 | 221 | 59.2 | 63.1 | 148 | 237 | 0 | 23.7 | 63.1 | 43.4 |
| Attenuator Air Volume | (ACMM) | 2.94 | 2.07 | 1.78 | 1.21 | 2.59 | 2.15 | 2.57 | 1.06 | >3 | 1.59 |
| Attenuator Gap (Top) | (mm) | 4.19 | 3.28 | 3.81 | 4.24 | 3.61 | 2.03 | 3.51 | 2.03 | 5.33 | 1.98 |
| Attenuator Gap (Bottom) | (mm) | 2.79 | 1.78 | 2.90 | 3.07 | 3.18 | 1.35 | 3.51 | 2.03 | 4.60 | 1.88 |
| Chute Length | (mm) | 152.4 | 152.4 | 152.4 | 152.4 | 76.2 | 228.6 | 25.4 | 152.4 | 152.4 | 152.4 |
| Die to Attenuator Distance | (mm) | 317.5 | 317.5 | 317.5 | 317.5 | 317.5 | 304.8 | 304.8 | 304.8 | 304.8 | 914.4 |
| Attenuator to Collector Dist | (mm) | 609.6 | 609.6 | 609.6 | 609.6 | 609.6 | 609.6 | 609.6 | 609.6 | 609.6 | 304.8 |
| Average Fiber Diameter | ($\mu$) | 10.56 | 9.54 | 15.57 | 14.9 | 13.09 | 10.19 | 11.19 | 9.9 | 22.26 | 14.31 |
| Apparent Filament Speed | (m/min) | 12600 | 15400 | 5770 | 6530 | 8200 | 13500 | 11200 | 6940 | 11400 | 6830 |
| Tenacity | (g/denier) | 2.48 | 4.8 | 1.41 | 1.92 | 2.25 | 2.58 | 2.43 | 2.31 | 0.967 | 1.83 |
| Percent elongation to break | (%) | 180 | 180 | 310 | 230 | 220 | 200 | 140 | 330 | 230 | 220 |
| Draw Area Ratio | | 1050 | 2800 | 3260 | 11400 | 1510 | 2490 | 2060 | 8060 | 1600 | 3860 |
| Melting Point-Middles | (° C.) | 165.4 | 165.0 | 164.1 | 164.1 | 165.2 | 164.0 | 164.3 | 165.2 | 164.3 | 165.4 |
| Second Peak | (° C.) | | | | | | | | | | |
| Melting Point-Ends | (° C.) | 163.9 | 164.0 | 163.4 | 163.4 | 163.2 | 162.5 | 164.0 | 163.3 | 164.3 | 163.2 |
| Second Peak | (° C.) | | | | | | | | | | |
| Crystallinity Index-Middles | | 0.44 | 0.46 | 0.42 | 0.48 | 0.48 | 0.52 | 0.39 | 0.39 | 0.50 | 0.40 |
| Crystallinity Index-Ends | | 0.56 | 0.38 | 0.48 | | 0.4 | 0.32 | 0.35 | 0.34 | 0.41 | 0.53 |
| Productivity Index | g · m/hole · min$^2$ | 12700 | 15500 | 5770 | 6760 | 8240 | 13600 | 11300 | 3380 | 45800 | 6830 |

| Example Number | | 11 | 12 | 13 | 14 | 15 | 16 | 17 | 18 | 19 |
|---|---|---|---|---|---|---|---|---|---|---|
| Polymer | | PP | PP | PP | PP | PP | PP | PP | PP | PP |
| MFI/IV | | 400 | 400 | 400 | 30 | 70 | 70 | 70 | 70 | 70 |
| Melt Temperature | (C.) | 190 | 196 | 183 | 216 | 201 | 201 | 208 | 207 | 206 |
| Number of Orifices | | 84 | 84 | 84 | 168 | 168 | 168 | 168 | 168 | 168 |
| Polymer Flow Rate | (g/orifice/min) | 1.00 | 1.00 | 1.00 | 0.50 | 1.00 | 0.50 | 0.50 | 0.50 | 0.50 |
| Orifice Diameter | (mm) | 0.889 | 0.889 | 1.588 | 0.508 | 0.343 | 0.343 | 0.343 | 0.343 | 0.343 |
| Orifice L/D | | 3.57 | 3.57 | 1.5 | 3.5 | 9.26 | 3.5 | 3.5 | 3.5 | 3.5 |
| Air Knife Gap | (mm) | 0.381 | 1.778 | 0.762 | 1.270 | 0.762 | 0.762 | 0.762 | 0.762 | 0.762 |
| Attenuator Body Angle | (degrees) | 20 | 40 | 30 | 30 | 30 | 30 | 30 | 30 | 30 |
| Attenuator Air Temperature | (C.) | 25 | 25 | 121 | 25 | 25 | 25 | 25 | 25 | 25 |
| Quench Air Rate | (ACMM) | 0 | 0.59 | 0.34 | 0.19 | 0.17 | 0 | 0.35 | 0.26 | 0.09 |
| Clamping Force | (Newtons) | 27.6 | 15.8 | 55.2 | 25.6 | 221 | 27.6 | 27.6 | 27.6 | 27.6 |
| Attenuator Air Volume | (ACMM) | 0.86 | 1.19 | 1.25 | 1.24 | 2.84 | 0.95 | 0.95 | 1.19 | 1.54 |
| Attenuator Gap (Top) | (mm) | 2.67 | 6.30 | 3.99 | 5.26 | 4.06 | 7.67 | 5.23 | 3.78 | 3.78 |
| Attenuator Gap (Bottom) | (mm) | 2.67 | 6.30 | 2.84 | 4.27 | 2.67 | 7.67 | 5.23 | 3.33 | 3.33 |
| Chute Length | (mm) | 152.4 | 76.2 | 152.4 | 152.4 | 152.4 | 152.4 | 152.4 | 152.4 | 152.4 |
| Die to Attenuator Distance | (mm) | 101.6 | 127 | 317.5 | 1181.1 | 317.5 | 108 | 304.8 | 292.1 | 292.1 |
| Attenuator to Collector Dist | (mm) | 914.4 | 304.8 | 609.6 | 330.2 | 609.6 | 990.6 | 787.4 | 800.1 | 800.1 |
| Average Fiber Diameter | ($\mu$) | 18.7 | 21.98 | 14.66 | 16.50 | 16.18 | 19.20 | 17.97 | 14.95 | 20.04 |
| Apparent Filament Speed | (m/min) | 4000 | 2900 | 6510 | 2570 | 5370 | 1900 | 2170 | 3350 | 1740 |
| Tenacity | (g/denier) | 0.52 | 0.54 | 1.68 | 2.99 | 2.12 | 2.13 | 2.08 | 2.56 | 0.87 |
| Percent elongation to break | (%) | 150 | 100 | 110 | 240 | 200 | 500 | 450 | 500 | 370 |
| Draw Area Ratio | | 2300 | 1600 | 12000 | 950 | 450 | 320 | 360 | 560 | 290 |
| Melting Point-Middles | (° C.) | 162.3 | 163.9 | 164.5 | 162.7 | 164.8 | 164.4 | 166.2 | 163.9 | 164.1 |
| Second Peak | (° C.) | | | | 167.3 | | | 164.4 | | |
| Melting Point-Ends | (° C.) | 163.1 | 163.4 | 164.3 | 163.5 | 163.8 | 163.7 | 164.0 | 163.9 | 163.9 |
| Second Peak | (° C.) | | | | 166.2 | | | | | |

TABLE 1-continued

| | | | | | | | | | | |
|---|---|---|---|---|---|---|---|---|---|---|
| Crystallinity Index-Middles | | 0.12 | 0.13 | 0.46 | 0.53 | 0.44 | 0.33 | 0.43 | 0.37 | 0.49 |
| Crystallinity Index-Ends | | 0.05 | 0.42 | 0.50 | 0.45 | 0.43 | 0.17 | | 0.38 | 0.44 |
| Productivity Index | g · m/hole · min$^2$ | 4000 | 2900 | 6500 | 1280 | 5390 | 950 | 1080 | 1680 | 870 |

| Example Number | | 20 | 21 | 22 | 23 | 24 | 25 | 26 | 27 |
|---|---|---|---|---|---|---|---|---|---|
| Polymer | | PP | PP | PP | PET | PET | PET | PET | PET |
| MFI/IV | | 70 | 70 | 70 | 0.61 | 0.61 | 0.61 | 0.61 | 0.36 |
| Melt Temperature | (C.) | 221 | 221 | 221 | 278 | 290 | 281 | 290 | 290 |
| Number of Orifices | | 168 | 168 | 168 | 168 | 168 | 84 | 84 | 168 |
| Polymer Flow Rate | (g/orifice/min) | 0.50 | 0.50 | 0.50 | 1.01 | 1.00 | 0.99 | 0.99 | 1.01 |
| Orifice Diameter | (mm) | 0.343 | 0.343 | 0.343 | 0.343 | 0.508 | 0.889 | 1.588 | 0.508 |
| Orifice L/D | | 3.5 | 3.5 | 3.5 | 3.5 | 3.5 | 3.57 | 3.5 | 3.5 |
| Air Knife Gap | (mm) | 0.762 | 0.762 | 0.762 | 1.778 | 1.270 | 0.762 | 0.381 | 1.270 |
| Attenuator Body Angle | (degrees) | 30 | 30 | 30 | 20 | 30 | 30 | 40 | 30 |
| Attenuator Air Temperature | (C.) | 25 | 25 | 25 | 25 | 25 | 25 | 25 | 25 |
| Quench Air Rate | (ACMM) | 0.09 | 0.30 | 0.42 | 0.48 | 0.35 | 0.35 | 0.17 | 0.22 |
| Clamping Force | (Newtons) | 27.6 | 150 | 17.0 | 3.9 | 82.8 | 63.1 | 3.9 | 86.8 |
| Attenuator Air Volume | (ACMM) | 1.61 | >3 | 1.61 | 2.11 | 2.02 | 2.59 | 0.64 | 2.40 |
| Attenuator Gap (Top) | (mm) | 3.78 | 3.78 | 3.78 | 4.83 | 5.08 | 5.16 | 2.21 | 5.03 |
| Attenuator Gap (Bottom) | (mm) | 3.33 | 3.35 | 3.35 | 4.83 | 3.66 | 4.01 | 3.00 | 3.86 |
| Chute Length | (mm) | 152.4 | 152.4 | 152.4 | 76.2 | 152.4 | 152.4 | 228.6 | 152.4 |
| Die to Attenuator Distance | (mm) | 508 | 508 | 685.8 | 317.5 | 533.4 | 317.5 | 317.5 | 127 |
| Attenuator to Collector Dist | (mm) | 584.2 | 584.2 | 431.8 | 609.6 | 762 | 609.6 | 609.6 | 742.95 |
| Average Fiber Diameter | ($\mu$) | 16.58 | 15.73 | 21.77 | 11.86 | 10.59 | 11.92 | 13.26 | 10.05 |
| Apparent Filament Speed | (m/min) | 2550 | 2830 | 1490 | 6770 | 8410 | 6580 | 5320 | 9420 |
| Tenacity | (g/denier) | 1.9 | 1.4 | 1.2 | 3.5 | 5.9 | 3.6 | 3.0 | 3.5 |
| Percent elongation to break | (%) | 210 | 220 | 250 | 40 | 30 | 40 | 50 | 20 |
| Draw Area Ratio | | 430 | 480 | 250 | 840 | 2300 | 5600 | 1400 | 2600 |
| Melting Point-Middles | (° C.) | 165.9 | 163.9 | 165.7 | 260.9 | 259.9 | 265.1 | 261.0 | 256.5 |
| Second Peak | (° C.) | | 167.2 | | 258.5 | 267.2 | — | 258.1 | 268.3 |
| Melting Point-Ends | (° C.) | 164.1 | 164.0 | 163.7 | 257.1 | 257.2 | 255.7 | 257.4 | 257.5 |
| Second Peak | (° C.) | | | | 253.9 | 254.3 | 268.7 | 253.9 | — |
| Crystallinity Index-Middles | | 0.5 | 0.39 | 0.40 | 0.10 | 0.20 | 0.27 | 0.25 | 0.12 |
| Crystallinity Index-Ends | | 0.5 | 0.09 | 0.51 | 0 | 0 | 0 | 0 | 0 |
| Productivity Index | g · m/hole · min$^2$ | 1270 | 1410 | 738 | 6820 | 8400 | 6520 | 5270 | 9500 |

| Example Number | | 28 | 29 | 30 | 31 | 32 | 33 | 34 | 35 |
|---|---|---|---|---|---|---|---|---|---|
| Polymer | | PET | PET | PET | PET | PET | Nylon | PS | Urethane |
| MFI/IV | | 0.85 | 0.61 | 0.61 | 0.61 | 0.61 | 130 | 15.5 | 37 |
| Melt Temperature | (C.) | 290 | 282 | 281 | 281 | 281 | 272 | 268 | 217 |
| Number of Orifices | | 84 | 168 | 168 | 168 | 168 | 84 | 168 | 84 |
| Polymer Flow Rate | (g/orifice/min) | 0.98 | 1.01 | 1.01 | 1.01 | 1.01 | 1.00 | 1.00 | 1.98 |
| Orifice Diameter | (mm) | 1.588 | 0.508 | 0.508 | 0.508 | 0.508 | 0.889 | 0.343 | 0.889 |
| Orifice L/D | | 3.57 | 6.25 | 6.25 | 6.25 | 6.25 | 6.25 | 9.26 | 6.25 |
| Air Knife Gap | (mm) | 0.762 | 0.762 | 0.762 | 0.762 | 0.762 | 0.762 | 0.762 | 0.762 |
| Attenuator Body Angle | (degrees) | 30 | 30 | 30 | 30 | 30 | 30 | 30 | 30 |
| Attenuator Air Temperature | (C.) | 25 | 25 | 25 | 25 | 25 | 25 | 25 | 25 |
| Quench Air Rate | (ACMM) | 0.19 | 0 | 0.48 | 0.48 | 0.35 | 0.08 | 0.21 | 0 |
| Clamping Force | (Newtons) | 39.4 | 82.8 | 86.8 | 82.8 | 82.8 | 39.4 | 71.0 | 86.8 |
| Attenuator Air Volume | (ACMM) | 1.16 | 2.16 | 2.16 | 2.15 | 2.15 | 2.12 | 2.19 | >3 |
| Attenuator Gap (Top) | (mm) | 3.86 | 3.68 | 3.68 | 3.58 | 3.25 | 4.29 | 4.39 | 4.98 |
| Attenuator Gap (Bottom) | (mm) | 3.10 | 3.10 | 3.10 | 3.10 | 2.64 | 3.84 | 3.10 | 4.55 |
| Chute Length | (mm) | 762 | 228.6 | 228.6 | 228.6 | 228.6 | 76.2 | 152.4 | 76.2 |
| Die to Attenuator Distance | (mm) | 317.5 | 88.9 | 317.5 | 457.2 | 685.8 | 317.5 | 317.5 | 317.5 |
| Attenuator to Collector Dist | (mm) | 609.6 | 609.6 | 609.6 | 482.6 | 279.4 | 831.85 | 609.6 | 609.6 |
| Average Fiber Diameter | ($\mu$) | 12.64 | 10.15 | 10.59 | 11.93 | 10.7 | 12.94 | 14.35 | 14.77 |
| Apparent Filament Speed | (m/min) | 5800 | 9230 | 8480 | 6690 | 8310 | 6610 | 5940 | 9640 |
| Tenacity | (g/denier) | 3.6 | 3.1 | 4.7 | 4.1 | 5.6 | 3.8 | 1.4 | 3.3 |
| Percent elongation to break | (%) | 30 | 20 | 30 | 40 | 40 | 140 | 40 | 140 |
| Draw Area Ratio | | 16000 | 2500 | 2300 | 1800 | 2300 | 4700 | 570 | 3600 |
| Melting Point-Middles | (° C.) | 268.3 | 265.6 | 265.3 | 262.4 | 261.4 | 221.2 | | 23.7? |
| Second Peak | (° C.) | 257.3 | 257.9 | 269.5 | | * | 218.2 | | ? |
| Melting Point-Ends | (° C.) | 254.1 | 257.2 | 257.2 | 257.4 | 257.4 | 219.8 | | ? |
| Second Peak | (° C.) | 268.9 | 268.4 | * | * | * | — | — | — |
| Crystallinity Index-Middles | | 0.22 | 0.09 | 0.32 | 0.35 | 0.35 | 0.07 | 0 | 0 |
| Crystallinity Index-Ends | | 0 | 0 | 0 | 0 | 0 | <0.05 | 0 | 0 |
| Productivity Index | g · m/hole · min$^2$ | 5690 | 9320 | 8560 | 6740 | 8380 | 6610 | 5940 | 19100 |

| Example Number | | 36 | 37 | 38 | 39 | 40 | 41 | 42 |
|---|---|---|---|---|---|---|---|---|
| Polymer | | PE | B1.Copol. | PS/copol. | PE/PSA | PE/PP | Nylon | PP |
| MFI/IV | | 30 | 8 | 15.5/8 | 30/.63 | 30/400 | 130 | 400 |
| Melt Temperature | (C.) | 200 | 275 | 269 | 205 | 205 | 271 | 206 |
| Number of Orifices | | 168 | 168 | 168 | 168 | 168 | 84 | 84 |
| Polymer Flow Rate | (g/orifice/min) | 0.99 | 0.64 | 1.14 | 0.83 | 0.64 | 0.99 | 2.00 |
| Orifice Diameter | (mm) | 0.508 | 0.508 | 0.508 | 0.508 | 0.508 | 0.889 | 0.889 |

TABLE 1-continued

| | | | | | | | | |
|---|---|---|---|---|---|---|---|---|
| Orifice L/D | | 6.25 | 6.25 | 6.25 | 6.25 | 6.25 | 6.25 | 6.25 |
| Air Knife Gap | (mm) | 0.762 | 0.762 | 0.762 | 0.762 | 0.762 | 0.762 | 0.762 |
| Attenuator Body Angle | (degrees) | 30 | 30 | 30 | 30 | 30 | 30 | 30 |
| Attenuator Air Temperature | (C.) | 25 | 25 | 25 | 25 | 25 | 25 | 25 |
| Quench Air Rate | (ACMM) | 0.16 | 0.34 | 0.25 | 0.34 | 0.34 | 0.08 | 0.33 |
| Clamping Force | (Newtons) | 205 | 0.0 | 27.6 | 23.7 | 213 | 150 | 41.1 |
| Attenuator Air Volume | (ACMM) | 2.62 | 0.41 | 0.92 | 0.54 | 2.39 | >3 | >3 |
| Attenuator Gap (Top) | (mm) | 3.20 | 7.62 | 3.94 | 4.78 | 3.58 | 4.19 | 3.25 |
| Attenuator Gap (Bottom) | (mm) | 2.49 | 7.19 | 3.56 | 4.78 | 3.05 | 3.76 | 2.95 |
| Chute Length | (mm) | 228.6 | 76.2 | 76.2 | 76.2 | 76.2 | 76.2 | 76.2 |
| Die to Attenuator Distance | (mm) | 317.5 | 666.75 | 317.5 | 330.2 | 292.1 | 539.75 | 317.5 |
| Attenuator to Collector Dist | (mm) | 609.6 | 330.2 | 800.1 | 533.4 | 546.1 | 590.55 | 609.6 |
| Average Fiber Diameter | ($\mu$) | 8.17 | 34.37 | 19.35 | 32.34 | 8.97 | 12.8 | 16.57 |
| Apparent Filament Speed | (m/min) | 19800 | 771 | 4700 | 1170 | 11000 | 6700 | 10200 |
| Tenacity | (lb/dtex) | 1.2 | | 1.2 | | 1.1 | 3.5 | 0.8 |
| Percent elongation to break | (%) | 60 | | 30 | | 100 | 50 | 170 |
| Draw Area Ratio | | 3900 | 220 | 690 | 250 | 3200 | 4800 | 2900 |
| Melting Point-Middles | (° C.) | 118.7 | | | | | | 165.1 |
| Second Peak | (° C.) | 123.6 | | | | | | |
| Melting Point-Ends | (° C.) | 122.1 | | | | | | 164.5 |
| Second Peak | (° C.) | | | | | | | |
| Crystallinity Index-Middles | | 0.72 | | 0 | 0 | 0.36 | 0.08 | 0.43 |
| Crystallinity Index-Ends | | 0.48 | | 0 | 0 | 0.26 | <0.05 | 0.47 |
| Productivity Index | g · m/hole · min$^2$ | 19535 | 497 | 5340 | 972 | 7040 | 6640 | 20400 |

| Example Number | | 43 | 44 | 45 | 46 | 47 |
|---|---|---|---|---|---|---|
| Polymer | | PP | PET | PETG | PETG | PSA |
| MFI/IV | | 400 | 0.61 | >70 | >70 | 0.63 |
| Melt Temperature | (C.) | 205 | 290 | 262 | 265 | 200 |
| Number of Orifices | | 84 | ** | 84 | 84 | 84 |
| Polymer Flow Rate | (g/orifice/min) | 2.00 | 0.82 | 1.48 | 1.48 | 0.60 |
| Orifice Diameter | (mm) | 0.889 | 0.38 | 1.588 | 1.588 | 0.508 |
| Orifice L/D | | 6.25 | 6.8 | 3.5 | 3.5 | 3.5 |
| Air Knife Gap | (mm) | 0.762 | 0.762 | 0.762 | 0.762 | 0.762 |
| Attenuator Body Angle | (degrees) | 30 | 30 | 30 | 30 | 30 |
| Attenuator Air Temperature | (C.) | 25 | 25 | 25 | 25 | 25 |
| Quench Air Rate | (ACMM) | 0.33 | 0 | 0.21 | 0.21 | 0 |
| Clamping Force | (Newtons) | 14.4 | 98.6 | 39.4 | 27.6 | *** |
| Attenuator Air Volume | (ACMM) | 2.20 | 1.5 | 0.84 | 0.99 | 0.56 |
| Attenuator Gap (Top) | (mm) | 4.14 | 4.75 | 3.66 | 3.56 | 6.30 |
| Attenuator Gap (Bottom) | (mm) | 3.61 | 4.45 | 3.38 | 3.40 | 5.31 |
| Chute Length | (mm) | 76.2 | 76.2 | 76.2 | 76.2 | 76.2 |
| Die to Attenuator Distance | (mm) | 317.5 | 102 | 317 | 635 | 330 |
| Attenuator to Collector Dist | (mm) | 609.6 | 838 | 610 | 495 | 572 |
| Average Fiber Diameter | ($\mu$) | 13.42 | 8.72 | 19.37 | 21.98 | 38.51 |
| Apparent Filament Speed | (m/min) | 15500 | 10200 | 3860 | 3000 | 545 |
| Tenacity | (g/denier) | 3.6 | 2.1 | 1.64 | 3.19 | — |
| Percent elongation to break | (%) | 130 | 40 | 60 | 80 | — |
| Draw Area Ratio | | 4388 | 1909 | 6716 | 5216 | 1699 |
| Melting Point-Middles | (° C.) | 164.8 | 257.4 | | | |
| Second Peak | (° C.) | | 254.4 | | | |
| Melting Point-Ends | (° C.) | 164.0 | 257.4 | | | |
| Second Peak | (° C.) | | 254.3 | | | |
| Crystallinity Index-Middles | | 0.46 | <0.05 | 0 | 0 | |
| Crystallinity Index-Ends | | 0.41 | 0 | 0 | 0 | |
| Productivity Index | g · m/hole · min$^2$ | 31100 | 8440 | 5700 | 4420 | 330 |

*multiple values
**meltblowing die,
***walls oscillated at 200 cycles/sec.

What is claimed is:

1. Apparatus for forming fibers comprising a) an extrusion head for extruding filaments of fiber-forming material through orifices in a die, b) a processing chamber aligned to receive the extruded filaments for passage through the chamber, the chamber being defined by two parallel walls, at least one of the walls being instantaneously movable to allow an instantaneous separation and reclosing of the walls during which processing of filaments continues essentially uninterrupted; and c) movement means for providing instantaneous movement of at least one wall.

2. Apparatus of claim 1 in which the movement means comprises biasing means for resiliently biasing the wall toward the other wall, movement of the wall toward and away from the other wall being sufficiently easy and rapid that the wall will move away from the other wall in response to increases in pressure within the chamber but will be quickly returned to its original position by the biasing means upon resumption of the original pressure within the chamber.

3. Apparatus of claim 2 in which the biasing means comprises an air cylinder having a sliding piston connected to said at least one wall, and the pressure applied to the piston can be adjusted to adjust the force biasing said wall toward the other wall.

4. Apparatus of claim 1 in which the movement means comprises oscillating means for oscillating the wall at a rapid rate.

5. Apparatus of claim 1 in which both parallel walls are instantaneously movable toward and away from one another and connected to movement means for providing instantaneous movement.

6. Apparatus of claim 1 that further includes one or more air knives disposed within the processing chamber and providing a fluid stream having a vector component along the longitudinal axis of the processing chamber to increase the velocity of filaments passing through the chamber.

7. Apparatus of claim 1 in which the at least one movable wall is segmented into parts that can move individually toward and away from the other wall.

8. Apparatus of claim 7 in which individual parts of the movable wall are subject to a grid of biasing means, oscillating means or other movement means to cause individual movement of the parts toward the other wall.

9. Apparatus of claim 1 in which the at least one movable wall is a flexible wall such that parts of the wall can move locally toward and away from the other wall.

10. Apparatus of claim 9 in which individual parts of the movable wall are subject to a grid of biasing means, oscillating means or other movement means to cause individual movement of the parts toward the other wall.

11. Apparatus of claim 1 in which the gap width of the chamber is greater near the entry to the chamber than toward the exit of the chamber.

12. Apparatus of claim 1 in which the gap width of the chamber is narrower near the entry to the chamber than toward the exit of the chamber.

13. Apparatus for forming fibers comprising a) an extrusion head for extruding filaments of fiber-forming material through orifices in a die, b) a processing chamber aligned to receive the extruded filaments for passage through the chamber, the chamber being defined by two parallel walls, at least one of the walls being instantaneously movable toward and away from the other wall; and c) movement means for providing instantaneous movement of at least one wall; said movement means comprising biasing means for resiliently biasing the wall toward the other wall; and movement of the wall toward and away from the other wall being sufficiently easy and rapid that the wall will move away from the other wall in response to increases in pressure within the chamber but will be quickly returned to its original position by the biasing means upon resumption of the original pressure within the chamber.

14. Apparatus of claim 13 in which the biasing means comprises an air cylinder having a sliding piston connected to said at least one wall, and the pressure applied to the piston can be adjusted to adjust the force biasing said wall toward the other wall.

15. Apparatus for forming fibers comprising a) an extrusion head for extruding filaments of fiber-forming material through orifices in a die, b) a processing chamber aligned to receive the extruded filaments for passage through the chamber, the chamber being defined by two parallel walls, at least one of the walls being instantaneously movable toward and away from the other wall; and c) movement means for providing instantaneous movement of at least one wall; the at least one movable wall being a flexible wall such that parts of the wall can move locally toward and away from the other wall.

16. Apparatus of claim 15 in which individual parts of the movable wall are subject to a grid of biasing means, oscillating means or other movement means to cause individual movement of the parts toward the other wall.

* * * * *